US006195076B1

(12) United States Patent
Sakuragi et al.

(10) Patent No.: US 6,195,076 B1
(45) Date of Patent: Feb. 27, 2001

(54) ELECTRON-BEAM GENERATING APPARATUS, IMAGE DISPLAY APPARATUS HAVING THE SAME, AND METHOD OF DRIVING THEREOF

(75) Inventors: Takamasa Sakuragi, Hiratsuka; Hidetoshi Suzuki, Fujisawa, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 08/825,122

(22) Filed: Mar. 27, 1997

(30) Foreign Application Priority Data

Mar. 28, 1996 (JP) ..... 8-074011
Mar. 19, 1997 (JP) ..... 9-066259

(51) Int. Cl.[7] ..... G09G 3/22

(52) U.S. Cl. ..... 345/74; 345/213; 315/160

(58) Field of Search ..... 345/55, 74, 75, 345/76, 77, 78, 212–213, 204, 208; 315/169.1, 169.3, 167, 160

(56) References Cited

U.S. PATENT DOCUMENTS

| | | | | |
|---|---|---|---|---|
| 4,053,812 | | 10/1977 | Kaji et al. | 315/169 |
| 4,904,895 | | 2/1990 | Tsukamoto et al. | 313/336 |
| 5,155,416 | | 10/1992 | Suzuki et al. | 315/366 |
| 5,313,140 | | 5/1994 | Smith et al. | 315/169.1 |
| 5,530,314 | | 6/1996 | Banno et al. | 313/310 |
| 5,552,677 | * | 9/1996 | Pagones | 315/169.1 |
| 5,572,231 | | 11/1996 | Kobori | 345/74 |
| 5,656,892 | * | 8/1997 | Zimlich et al. | 345/212 |
| 5,742,267 | * | 4/1998 | Wilkinson | 345/77 |
| 5,834,900 | * | 11/1998 | Tanaka et al. | 345/74 |
| 5,844,368 | * | 12/1998 | Okuda et al. | 345/77 |
| 5,856,812 | * | 1/1999 | Hush et al. | 345/77 |
| 5,920,154 | * | 7/1999 | Hush | 345/77 |

FOREIGN PATENT DOCUMENTS

| | | | |
|---|---|---|---|
| 0 589 523 A1 | | 3/1994 | (EP) . |
| 0 596 242 B1 | | 5/1994 | (EP) . |
| 0688035 | * | 12/1995 | (EP) . |

(List continued on next page.)

OTHER PUBLICATIONS

"Field Emission", W. P. Dyke and W. W. Dolan, *Advances in Electronics and Electron Physics*, vol. III, pp. 89–185 (1956).

"Operation of Tunnel–Emission Devices", C. A. Mead, *Journal of Applied Physics*, vol. 32, No. 4, pp. 646–652 (Apr. 1961).

"Emission of Hot Electrons and the Field Emission of Electrons from Tin Oxide", M.I. Elinson et al., *Radio Engineering and Electronic Physics*, pp. 1290–1296 (Jul. 1965).

(List continued on next page.)

*Primary Examiner*—Kent Chang
(74) *Attorney, Agent, or Firm*—Fitzpatrick, Cella, Harper & Scinto

(57) ABSTRACT

A driving circuit and a driving method capable of uniformly outputting an electron beam at high speed from a multi-electron-beam source (50) having a plurality of cold cathode devices wired in a matrix, to provide a display apparatus having a characteristic of less unevenness in display luminance, a superior linearity in grayscale, and fast response. The electron-beam generating apparatus includes a multi-electron-beam source (50) having a plurality of cold cathode devices wired with row wiring and column wiring and arranged in a matrix form, a scanning circuit (2) connected to the row wiring, and modulation circuits (10, 20, 30) connected to the column wiring. The modulation circuits (10, 20, 30) include: a controlled current source (10) for supplying a driving current pulse to the cold cathode devices, a voltage source (20) for quickly charging parasitic capacity of the multi-electron-beam source (50), and a charging-voltage applying circuit (30) for electrically connecting the voltage source and the column wiring in synchronization with a rise of the driving current pulse.

21 Claims, 23 Drawing Sheets

FOREIGN PATENT DOCUMENTS

| | | |
|---|---|---|
| 0 688 035 A1 | 12/1995 | (EP) . |
| 2 707 032 | 12/1994 | (FR) . |
| 64-31332 | 2/1989 | (JP) . |
| 2-257551 | 10/1990 | (JP) . |
| 3-55738 | 3/1991 | (JP) . |
| 4-28137 | 1/1992 | (JP) . |
| 92-9018 | 5/1992 | (KR) . |
| 92/05571 | 4/1992 | (WO) . |

OTHER PUBLICATIONS

"Electrical Conduction and Electron Emission of Discontinuous Thin Film", G. Dittmer, *Thin Solid Films*, vol. 9, pp. 317–328 (!972).

"Strong Electron Emission from Patterned Tin–Indium Oxide Thin Films", M. Hartwell and C.G. Fonstad, *IEDM Technical Digest*, pp. 519–521, (International Electron Devices Meeting, 1975).

"Electroforming and Electron Emission of Carbon Thin Films", H. Araki et al., *Journal of Vacuum Society of Japan*, vol. 26, No. 1, pp. 22–29 (1981).

"Physical Properties of Thin–Film Field Emission Cathodes with Molybdenum Cones", C.A. Spindt et al., *Journal of Applied Physics*, vol. 47, No. 12, pp. 5248–63 (Dec. 1976).

* cited by examiner

OUTPUT WAVEFORM OF SCANNING CIRCUIT 2

OUTPUT VOLTAGE OF PULSE-WIDTH MODULATOR 8

OUTPUT VOLTAGE OF VOLTAGE AMPLIFIER 21

POTENTIAL OF COLUMN WIRING

OUTPUT CURRENT OF VOLTAGEAMPLIFIER 21

SINK CURRENT OF CURENT SWITCH 33

DEVICE CURENT (If)

EMISSION CURRENT (Ie)

ELECTRON-BEAM GENERATING APPARATUS, IMAGE DISPLAY APPARATUS HAVING THE SAME, AND METHOD OF DRIVING THEREOF

BACKGROUND OF THE INVENTION

The present invention relates to an electron-beam generating apparatus having a multi-electron-beam source in which a plurality of cold cathode devices are wired in a matrix, an image display apparatus using the electron-beam generating apparatus, and a method of driving these apparatuses.

Conventionally, two types of devices, namely thermionic and cold cathode devices, are known as electron-emitting devices. Examples of cold cathode devices are surface-conduction electron-emitting devices, field-emission-type devices (to be referred to as FE-type devices hereinafter), and metal/insulator/metal type emission devices (to be referred to as MIM-type devices hereinafter).

A known example of the surface-conduction electron-emitting devices is described in, e.g., M. I. Elinson, et al., "The Emission of Hot Electrons and the Field Emission of Electrons from Tin Oxide," Radio. Eng. Electronic Phys., 10, 1290 (1965) and other examples to be described later.

The surface-conduction electron-emitting device utilizes the phenomenon in which electron emission is caused in a small-area thin film formed on a substrate, by providing a current parallel to the film surface. The surface-conduction electron-emitting device includes devices using an Au thin film (G. Dittmer, "Electrical Conduction and Electron Emission of Discontinuous Thin Films," Thin Solid Films, 9,317 (1972)), an $In_2O_3/SnO_2$ thin film (M. Hartwell and C. G. Fonstad, "Strong Electron Emission From Patterned Tin-Indium Oxide Thin Films," IEEE Trans. ED Conf., 519 (1975)), and a carbon thin film (Hisashi Araki, et al., "Electroforming and Electron Emission of Carbon Thin Films," Vacuum, Vol. 26, No. 1, p. 22 (1983)), and the like, in addition to an $SnO_2$ thin film according to Elinson mentioned above.

FIG. 23 is a plan view of the surface-conduction emitting device according to M. Hartwell et al. as a typical example of the structures of these surface-conduction electron-emitting devices. Referring to FIG. 23, reference numeral 3001 denotes a substrate; and 3004, a conductive thin film made of metal oxide formed by sputtering. This conductive thin film 3004 has an H-shaped plane pattern, as shown in FIG. 23. An electron-emitting portion 3005 is formed by performing an electrification process (referred to as an energization forming process to be described later) with respect to the conductive thin film 3004. Referring to FIG. 23, a spacing L is set to 0.5 to 1 mm, and a width W is set to 0.1 mm. The electron-emitting portion 3005 is shown in a rectangular shape at the center of the conductive thin film 3004 for the sake of illustrative convenience, however, this does not exactly show the actual position and shape of the electron-emitting portion.

In the above surface-conduction electron-emitting device by M. Hartwell et al., typically the electron-emitting portion 3005 is formed by performing the electrification process called energization forming process for the conductive thin film 3004 before electron emission. According to the energization forming process, electrification is performed by applying a constant or varying DC voltage which increases at a very slow rate of, e.g., 1 V/min, to both ends of the conductive thin film 3004, so as to partially destroy or deform the conductive thin film 3004 or change the properties of the conductive thin film 3004, thereby forming the electron-emitting portion 3005 with an electrically high resistance. Note that the destroyed or deformed part of the conductive thin film 3004 or part where the properties are changed has a fissure. Upon application of an appropriate voltage to the conductive thin film 3004 after the energization forming process, electron emission occurs near the fissure.

Known examples of the FE-type devices are described in W. P. Dyke and W. W. Dolan, "Field Emission", Advances in Electronics Electron Physics, 8,89 (1956) and C. A. Spindt et al., "Physical Properties of Thin Field Emission Cathodes with Molybdenum Cones", J. Appl. Phys., 47,5248 (1976).

FIG. 24 is a cross-sectional view of the device according to C. A. Spindt et al. as a typical example of the construction of the FE-type devices. Referring to FIG. 24, reference numeral 3010 denotes a substrate; 3011, an emitter wiring comprising an electrically conductive material; 3012, an emitter cone; 3013, an insulating layer; and 3014, a gate electrode. The device is caused to produce field emission from the tip of the emitter cone 3012 by applying an appropriate voltage across the emitter cone 3012 and gate electrode 3014.

In another example of the construction of an FE-type device, the stacked structure of the kind shown in FIG. 24 is not used. Rather, the emitter and gate electrode are arranged on the substrate in a state substantially parallel to the plane of the substrate.

A known example of the MIM-type is described by C. A. Mead, "Operation of Tunnel-Emission Devices", J. Appl. Phys., 32, 646 (1961). FIG. 25 is a sectional view illustrating a typical example of the construction of the MIM-type device. Referring to FIG. 25, reference numeral 3020 denotes a substrate; 3021, a lower electrode consisting of metal; 3022, a thin insulating layer having a thickness on the order of 100 Å; and 3023, an upper electrode consisting of metal and having a thickness on the order of 80 to 300 Å. The device is caused to produce field emission from the surface of the upper electrode 3023 by applying an appropriate voltage across the upper electrode 3023 and lower electrode 3021.

Since the above-mentioned cold cathode device makes it possible to obtain electron emission at a lower temperature in comparison with a thermionic cathode device, a heater for applying heat is unnecessary. Accordingly, the structure is simpler than that of the thermionic cathode device and it is possible to fabricate devices that are finer. Further, even though a large number of devices are arranged on a substrate at a high density, problems such as fusing of the substrate do not easily occur. In addition, the cold cathode device differs from the thermionic cathode device in that the latter has a slow response because it is operated by heat produced by a heater. Thus, an advantage of the cold cathode device is the quicker response.

For these reasons, extensive research into applications for cold cathode devices is being carried out.

By way of example, among the various cold cathode devices, the surface-conduction electron-emitting device is particularly simple in structure and easy to manufacture and therefore is advantageous in that a large number of devices can be formed over a large area. Accordingly, research has been directed to a method of arraying and driving a large number of the devices, as disclosed in Japanese Patent Application Laid-Open No. 64-31332, filed by the present applicant.

Further, applications of surface-conduction electron-emitting devices that have been researched are image forming apparatuses such as an image display apparatus and an image recording apparatus, charged beam sources, and the like.

As for applications to an image display apparatus, research has been conducted with regard to such an image display apparatus using, in combination, surface-conduction electron-emitting devices and phosphors which emit light in response to irradiation by an electron beam, as disclosed, for example, in the specifications of U.S. Pat. No. 5,066,883 and Japanese Patent Application Laid-Open Nos. 2-257551 and 4-28137 filed by the present applicant. The image display apparatus using the combination of the surface-conduction electron-emitting devices and phosphors is expected to have characteristics superior to those of the conventional image display apparatus of other types. For example, in comparison with liquid-crystal display apparatuses that have become so popular in recent years, the above-mentioned image display apparatus is superior since it emits its own light and therefore does not require back-lighting. It also has a wider viewing angle.

A method of driving a number of FE-type devices in a row is disclosed, for example, in the specification of U.S. Pat. No. 4,904,895 filed by the present applicant. A flat-type display apparatus reported by R. Meyer et al., for example, is known as an example of an application of an FE-type device to an image display apparatus. [R. Meyer: "Recent Development on Microtips Display at LETI", Tech. Digest of 4th Int. Vacuum Microelectronics Conf., Nagahama, pp. 6~9, (1991).]

An example in which a number of MIM-type devices are arrayed in a row and applied to an image display apparatus is disclosed in the specification of Japanese Patent Application Laid-Open No. 3-55738 filed by the present applicant.

The present inventors have examined electron-emitting devices according to various materials, manufacturing methods, and structures, in addition to the above conventional devices. The present inventors have also studied a multi-electron-beam source in which a large number of electron-emitting devices are arranged, and an image display apparatus to which this multi-electron-beam source is applied.

The present inventors have also examined a multi-electron-beam source according to an electric wiring method shown in FIG. 26. More specifically, this multi-electron-beam source is constituted by two-dimensionally arranging a large number of electron-emitting devices and wiring these devices in a matrix, as shown in FIG. 26.

Referring to FIG. 26, reference numeral 4001 denotes an electron-emitting device; 4002, a row wiring; and 4003, a column wiring. In reality, the row wiring 4002 and the column wiring 4003 include limited electrical resistance; yet, in FIG. 26, they are represented as wiring resistances 4004 and 4005. The wiring shown in FIG. 26 is referred to as simple matrix wiring.

For illustrative convenience, the multi-electron-beam source constituted by a 6×6 matrix is shown in FIG. 26. However, the scale of the matrix is not limited to this arrangement. In a multi-electron-beam source for an image display apparatus, a number of devices sufficient to perform the desired image display are arranged and wired.

In the multi-electron-beam source in which the electron-emitting devices are wired in a simple matrix, appropriate electrical signals are supplied to the row wiring 4002 and the column wiring 4003 to output desired electron beams. For instance, when the electron-emitting devices of one arbitrary row in the matrix are to be driven, a selection voltage $V_s$ is applied to the row wiring 4002 of the selected row. Simultaneously, a non-selection voltage $V_{ns}$ is applied to the row wiring 4002 of unselected rows. In synchronization with this operation, a driving voltage $V_e$ for outputting electron beams is applied to the column wiring 4003. According to this method, a voltage $(V_e-V_s)$ is applied to the electron-emitting devices of the selected row, and a voltage $(V_e-V_{ns})$ is applied to the electron-emitting devices of the unselected rows, assuming that a voltage drop caused by the wiring resistances 4004 and 4005 is negligible. When the voltages $V_e$, $V_s$, and $V_{ns}$ are set to appropriate levels, electron beams with a desired intensity are output from only the electron-emitting devices of the selected row. When different levels of driving voltages $V_e$ are applied to the respective column wiring 4003, electron beams with different intensities are output from the respective devices of the selected row. Since the response rate of the cold cathode device is fast, the period of time over which electron beams are output can also be changed in accordance with the period of time for applying the driving voltage $V_e$.

Accordingly, the multi-electron-beam source having electron-emitting devices arranged in a simple matrix can be used in a variety of applications. For example, the multi-electron-beam source can be suitably used as an electron source for an image display apparatus by appropriately supplying a voltage signal according to image data.

However, when a voltage source is actually connected to the multi-electron-beam source and the multi-electron-beam source is driven in the above described method of voltage application, a problem arises in that the voltage practically supplied to each of the electron-emitting devices is varied since the voltage drops due to wiring resistance.

A primary cause of such variance in the voltage applied to each of the devices is the difference in wiring lengths for each of the electron-emitting devices wired in a simple matrix (i.e., magnitudes of wiring resistances are different for each of the devices).

The second cause is the non-uniform voltage drop caused by the wiring resistance 4004 in respective portions of the row wiring. Since the current flowing from the row wiring of the selected row is diverged to each of the electron-emitting devices connected to the selected row, levels of the current provided to each of the wiring resistances 4004 are not uniform, causing the aforementioned non-uniformity.

The third cause is in that the level of voltage drop caused by the wiring resistance varies depending on a driving pattern (an image pattern to be displayed). This is because the current provided to the wiring resistance changes in accordance with a driving pattern.

Due to the aforementioned causes, the voltage applied to each of the electron-emitting devices varies. Therefore, an intensity of an electron beam outputted from each of the electron-emitting devices deviates from a desired value, causing a problem in applications. For instance, in a case where the above-described method is applied to an image display apparatus, luminance of a displayed image becomes non-uniform, or the luminance changes depending on a displayed image pattern.

Furthermore, since the variance of voltage tends to be greater as the scale of the simple matrix becomes large, the number of pixels in the image display apparatus has to be limited.

In view of the above problems, the present inventors have conducted extensive studies and have experimented with a driving method different from the aforementioned voltage application method.

More specifically, according to the experimental method, upon driving a multi-electron-beam source in which the electron-emitting devices are wired in a simple matrix, instead of connecting the voltage source with the column wiring to apply the driving voltage $V_e$, a current source is connected to supply a current necessary to output desired electron beams. In this method, the level of emission current $I_e$ is controlled by controlling the level of device current $I_f$.

In other words, the level of device current $I_f$ to be provided to each electron-emitting device is determined by referring to a characteristic representing (device current $I_f$) vs. (emission current $I_e$) of the electron-emitting device, and the determined level of the device current $I_f$ is supplied by the current source connected to the row wiring. More specifically, the driving circuit is constructed by combining electric circuits such as a memory storing the characteristic representing (device current $I_f$) vs. (emission current $I_e$), a calculator for determining the device current $I_f$ to be provided, a controlled current source and the like. The controlled current source of the driving circuit may employ a form of a circuit in which the level of the device current $I_f$ to be provided is first converted to a voltage signal and then to current by a voltage/current converter.

According to the above current source method, as compared with the foregoing driving method of connecting a voltage source, it is less likely to be influenced by voltage drop due to the wiring resistance. Therefore, the above method provides a considerable effect to minimize the variance and change in intensity of output electron beams (EPA 688 035).

However, the driving method of connecting a current source still raises the following problems.

That is, in a case where a constant current pulse having a short time-width is supplied from a controlled constant current source to the multi-electron-beam source in which a considerably large number of electron-emitting devices are wired in a matrix, an electron-beam is hardly emitted. If the constant current pulse is continuously supplied for a relatively long period of time, electron-beams are emitted as a matter of course; however, a long start-up time is necessary to start the electron emission.

FIGS. 22B–22E are time charts for explaining the above. FIG. 22B is a graph showing timing for scanning the row wiring; FIG. 22C, a graph showing a current waveform output from the controlled constant current source; FIG. 22D, a graph showing the driving current practically provided to the electron-emitting devices; and FIG. 22E, a graph showing the intensity of electron beams emitted from the electron-emitting devices. As can be seen from these figures, when a short current pulse is supplied from the controlled constant current source, device current $I_f$ is not provided to the electron-emitting devices. If a long current pulse is supplied, the driving current provided to the electron-emitting devices has a waveform with a large rise-time.

Although a cold cathode type electron-emitting device has a characteristic of fast response, since the current waveform has a long rise time, the resulting waveform of the emission current $I_e$ is also deformed.

The foregoing problems arise due to the following reasons. In a multi-electron-beam source where electron-emitting devices are wired in a simple matrix, parasitic capacity increases as the scale of the matrix is enlarged. The parasitic capacity is mainly present where the row wiring and column wiring intersect. An equivalent circuit thereof is shown in FIG. 22A. When a controlled constant current source 11 connected to a column wiring 54 starts supplying a constant current $I_1$, the supplied current is first consumed to charge parasitic capacity 48 before the supplied current serves as a driving current for electron-emitting devices 41. Thus, the practical response speed of the electron-emitting devices is reduced.

More specifically, to attain practical light emission luminance in a display apparatus having cold cathode devices and phosphors, it is necessary to supply, generally speaking, at least 1 $\mu$A to 10 mA of driving current, to a cold cathode device corresponding to one pixel. If a driving current larger than necessary is supplied, a problem arises in that the life of the cold cathode devices is shortened.

To cope with the above problems, an output current of the controlled constant current source is controlled to an appropriate value ranging from 1 $\mu$A to 1 mA. (In reality, the most appropriate value of driving current is determined in consideration of the type, material, and the form of the cold cathode, or efficiency of light emission and an acceleration voltage of the phosphors.)

Meanwhile, in order to serve as a practical television set or a computer display, it is preferable to have, e.g., the number of pixels of a display screen equal to more than 500×500 and a screen whose diagonal size is larger than 15 inches. If the matrix wiring is to be formed by utilizing a general technique of deposition, wiring resistance r and parasitic capacity c are produced, as has been described above. The circuit has a charging time constant Tc which depends upon the magnitude of r and c. (Strictly speaking, the time constant of the circuit also depends upon plural parameters, as a matter of course.)

In the case of driving the electron-emitting devices with the voltage source, the response speed of the electron-emitting devices which are connected in parallel to the parasitic capacity depends upon the time constant Tc.

However, in a case where a constant current ranging from 1 $\mu$A to 1 mA is supplied by the controlled current source as described above, the time necessary for charging is even longer than the above time constant Tc. In other words, the practical response speed of the electron-emitting devices is slower than that in the case of driving by a voltage source.

Accordingly, in a case where light emission luminance in a display apparatus is controlled by the pulse-width modulating method, linearity of a grayscale in a low luminance portion is deteriorated. Moreover, when an image moving in quick motion is displayed, a viewer receives an unnatural image.

As described above, in the case where a modulated signal is supplied by a controlled constant current source, the influence of voltage drop due to wiring resistance is greatly improved. However, the practical response speed is reduced, resulting in deteriorated quality of a displayed image. If an area of a display screen is enlarged or the number of pixels in the display screen is increased, the parasitic capacity is increased, thus the above problem has become more evident.

SUMMARY OF THE INVENTION

The present invention has been made in consideration of the above situation, and has as its object to provide driving means and a driving method for uniformly outputting electron-beams at high speed from a multi-electron-beam source comprising a large number of electron-emitting devices wired in a matrix. Another object of the present invention is to provide a display apparatus which has no luminance unevenness, realizes superior linearity of a grayscale and has a characteristic of quick response.

In order to attain the above objects, according to the present invention, an electron-beam generating apparatus, having a multi-electron-beam source where a plurality of cold cathode devices are wired with row wiring and column wiring arranged in a matrix form, scanning means connected to the row wiring, and modulation means connected to the column wiring, is characterized in that the modulation means comprises: a controlled current source for supplying a driving current pulse to the cold cathode devices; a voltage source for charging parasitic capacity of the multi-electron-beam source at high speed; and a charging-voltage apply means for electrically connecting the voltage source and the column wiring in synchronization with a rise of the driving current pulse.

Herein, the charging-voltage apply means is preferably the means including a rectifier or means including a timer circuit and a connection switch.

Furthermore, the voltage outputted by the voltage source is within a range of 0.5–0.9 times the maximum potential generated by the controlled current source.

Moreover, the electron-beam generating apparatus is characterized in that the voltage source is a variable voltage source capable of adjusting an output voltage.

Furthermore, the controlled current source preferably includes a constant current circuit and a current switch, or a V/I conversion circuit.

Furthermore, the charging-voltage apply means is preferably a level shift circuit where a plurality of diodes or transistors are connected.

The electron-beam generating apparatus according to the present invention constitutes an image display apparatus if combined with image forming members which form an image irradiated by an electron beam generated by the above-mentioned electron-beam generating apparatus. The present invention also includes this image display apparatus.

Moreover, the present invention includes a driving method of an electron-beam generating apparatus having a multi-electron-beam source where a plurality of cold cathode devices are wired with row wiring and column wiring arranged in a matrix form, wherein a driving current pulse, modulated in accordance with modulation data inputted from an external unit, is supplied to the column wiring, and a charging voltage is applied to the column wiring in addition to the driving current pulse during a period from a rise of the driving current pulse until a point at which parasitic capacity of the multi-electron-beam source is charged to a predetermined level.

Still further, the present invention includes a driving method of an image display apparatus having a multi-electron-beam source where a plurality of cold cathode devices are wired with row wiring and column wiring arranged in a matrix form, wherein a driving current pulse, modulated in accordance with modulation data inputted from an external unit, is supplied to the column wiring, and a charging voltage is applied to the column wiring in addition to the driving current pulse during a period from a rise of the driving current pulse until a point at which parasitic capacity of the multi-electron-beam source is charged to a predetermined level.

According to the present invention, in order to drive a multi-electron-beam source in which cold cathode devices are wired in a matrix, a voltage for quickly charging parasitic capacity is applied by a charging-voltage apply circuit in addition to a driving current being supplied from a controlled current source. By virtue of the above, it is possible for electron-emitting devices to respond fast. After the parasitic capacity is charged, the charging-voltage apply circuit is turned off, and the electron-emitting devices are driven by the controlled current source. Therefore, the cold cathode devices can be driven quickly, without being influenced by wiring resistance. Accordingly, an image display apparatus applying the present invention has superior linearity of a grayscale. Also, a viewer receives a natural image when a moving-image is displayed. Particularly, since the present invention enables quick charging of parasitic capacity in a display apparatus having a large display screen, an image can be displayed with high quality.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIGS. 19A–19F are cross sectional views showing steps of manufacturing the step-type surface-conduction electron-emitting device;

DETAILED DESCRIPTION OF THE PREFERRED EMBODIMENTS

Preferred embodiments of the present invention will be described in detail in accordance with the accompanying drawings.

Figure 1:
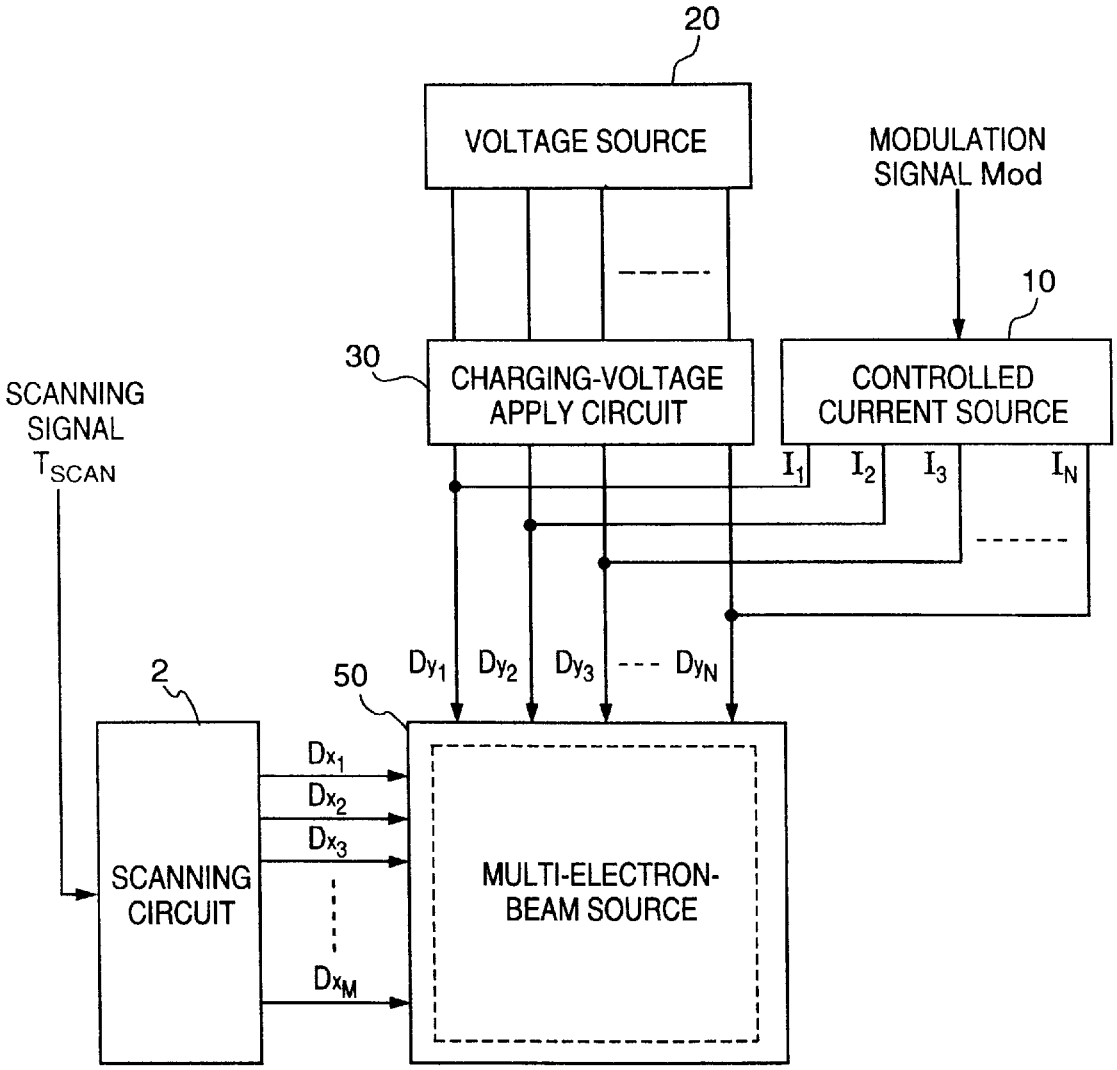
FIG. 1 is a block diagram showing a general construction of the present invention.

FIG. 1 is a block diagram showing a general construction of driving means according to the present invention. Referring to FIG. 1, reference numeral 10 denotes a controlled current source; 20, a voltage source; 30, a charging-voltage apply circuit; 2, a scanning circuit; and 50, a multi-electron-beam source. Hereinafter, each of the units will be described in detail.

As has been explained above, the multi-electron-beam source 50 includes M×N number of cold cathode devices in which M number of row wirings and N number of column wirings are arranged in a matrix. Each of the row wirings is electrically connected to the scanning circuit 2 via connection terminals $Dx_1$ to $Dx_m$. Each of the column wirings is electrically connected to the controlled current source 10 and charging-voltage apply circuit 30 via connection terminals $Dy_1$ to $Dy_N$.

The controlled current source 10 outputs current signals ($I_1$ to $I_N$), modulated on the basis of a modulation signal Mod, to the multi-electron-beam source 50. A so-called V/I converter may be utilized as the controlled current source; more specifically, it is preferable to utilize a circuit employing reference numerals 11, 22 and 33 in FIG. 4 or a current mirror circuit shown in FIG. 10B.

The voltage source 20 is used for charging parasitic capacity existing in the multi-electron-beam source 50 in a short period of time. More specifically, a DC constant voltage source or a pulse voltage source may be utilized. It is even more preferable to utilize a variable voltage source so that the charging voltage is adjustable.

Figure 2A:
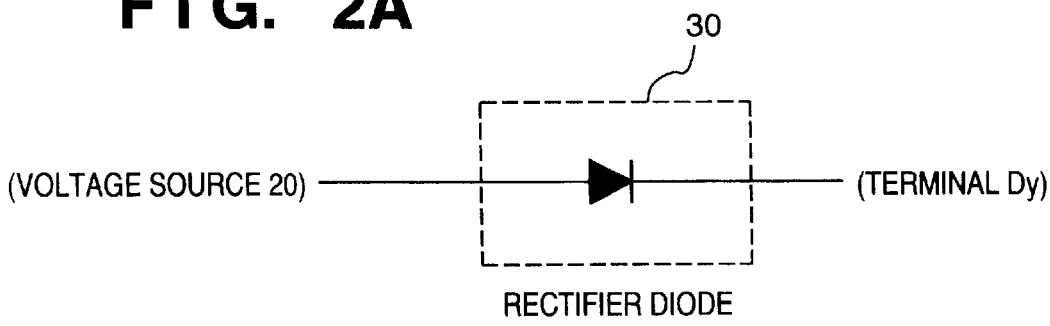
FIGS. 2A–2D show a charging-voltage apply circuit.
Figure 2B:
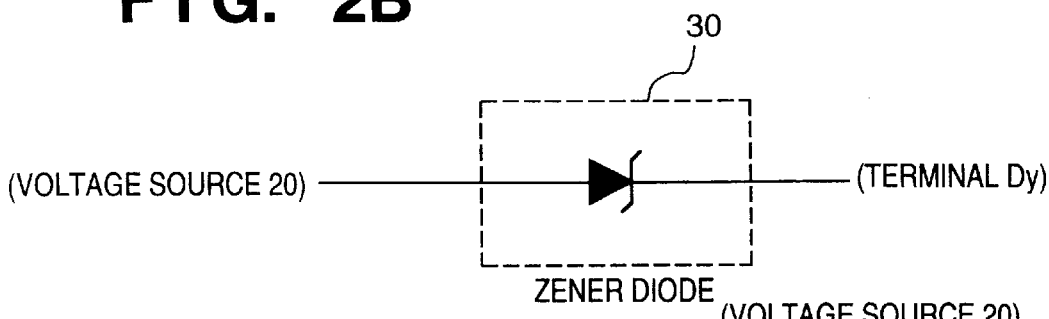
Figure 2C:
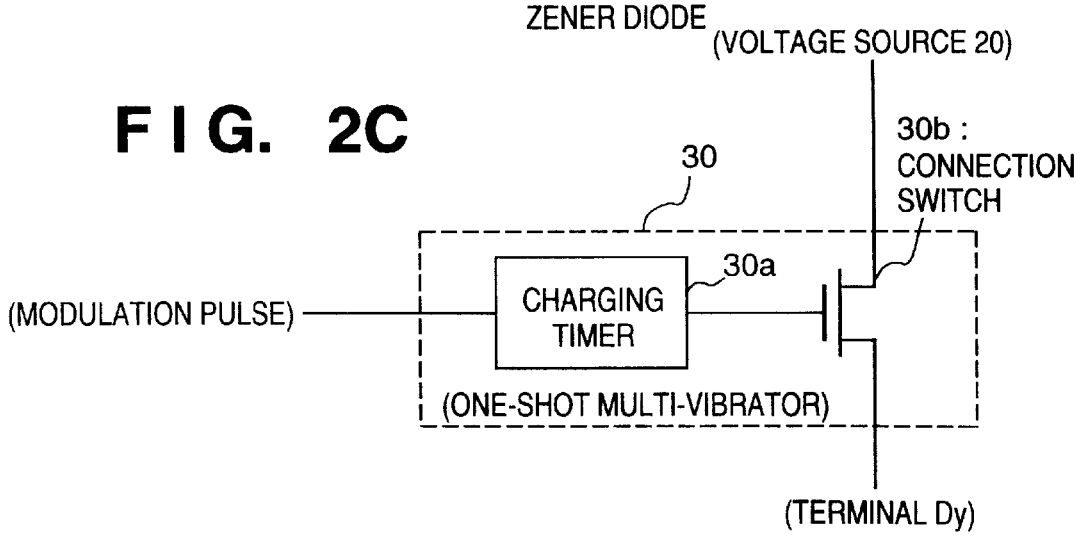
Figure 2D:
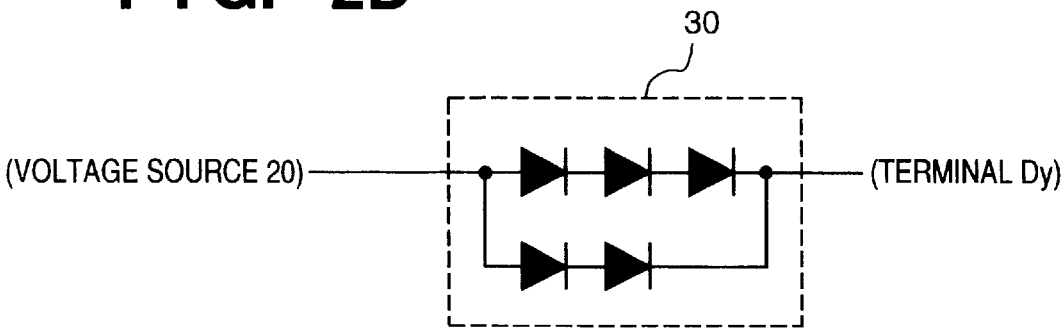

The charging-voltage apply circuit 30 is used for electrically connecting the voltage source 20 and connection terminals $Dy_1$ to $Dy_N$ only for a period of time necessary for charging the parasitic capacity. For example, a rectifier circuit such as that shown in FIGS. 2A or 2B, or a timer switch circuit where a timer 30*a* and a connection switch 30*b* are combined as shown in FIG. 2C may be utilized. The rectifier circuit is particularly preferable since it provides an advantage such that the voltage source and connection terminals are smoothly disconnected (i.e. no noise is generated) upon completing charging of the parasitic capacity. Note that if diodes or transistors are connected in series in a plurality of steps, it is possible to alter the charging voltage in accordance with the number of steps connected (a level shift function). In addition, even smoother charging is possible by providing a plurality of rectifier circuits having different shift voltages in parallel, as shown in FIG. 2D.

Figure 3:
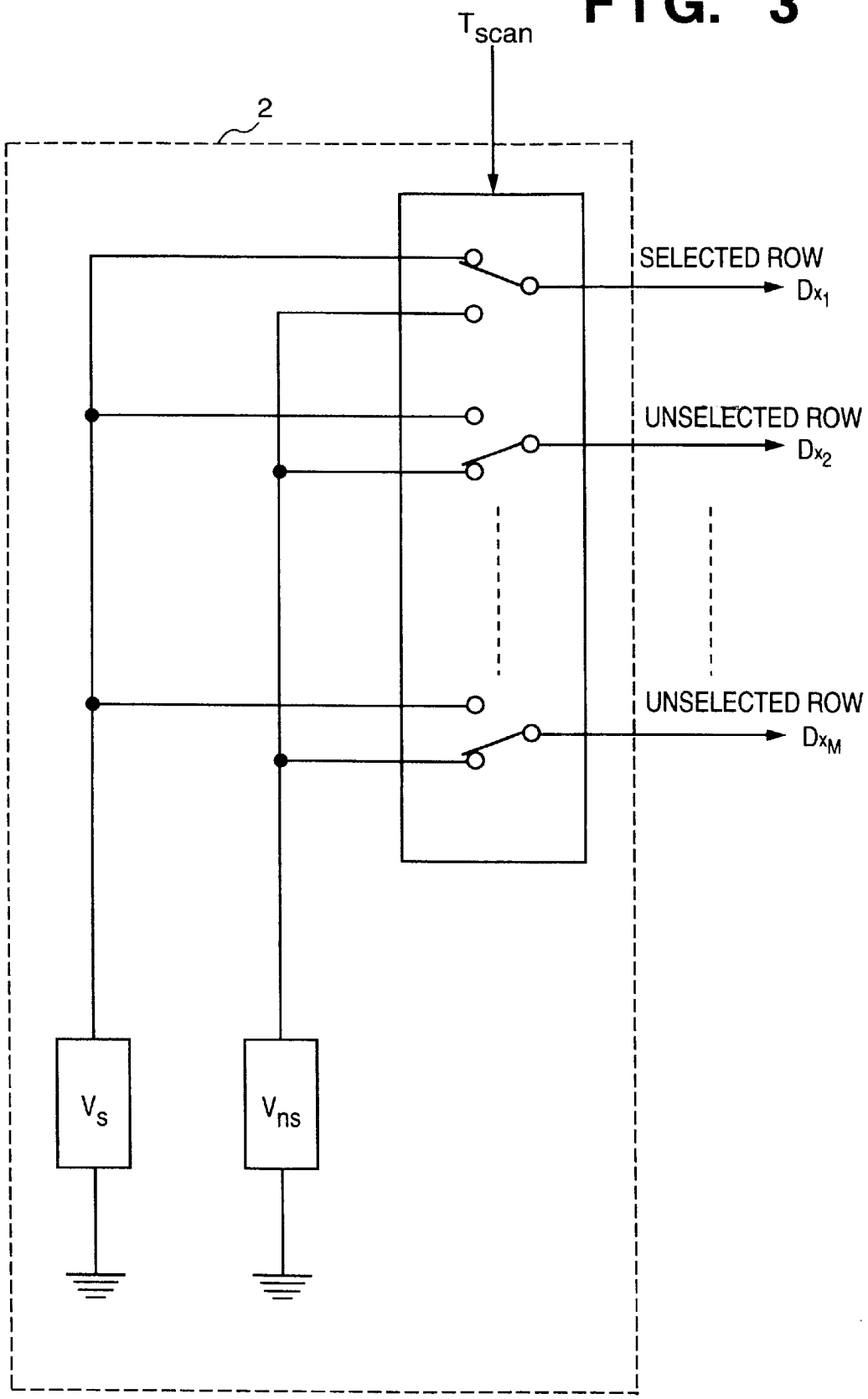
FIG. 3 shows a scanning circuit.

The scanning circuit 2 is utilized to sequentially apply a selection voltage $V_s$ and a non-selection voltage $V_{ns}$ to the row wiring of the multi-electron-beam source 50 in accordance with a scanning signal $T_{SCAN}$. For instance, a circuit as shown in FIG. 3 may be utilized.

The driving method according to the present invention will be described next. When an arbitrary electron-emitting device in the multi-electron-beam source 50 is to be driven, the current pulse I is outputted from the controlled current source 10 to the column wiring of the multi-electron-beam source 50 in accordance with the modulation signal Mod. In synchronization with a rise of the current pulse, a charging voltage is applied from the charging-voltage apply circuit 30. When charging of the parasitic capacity is almost completed, the voltage application from the charging-voltage apply circuit 30 is stopped, thereafter driving current is supplied from the controlled current source 10 to the electron-emitting device. According to the above driving method, charging of the parasitic capacity is performed by the cooperation of both the controlled current source and the charging-voltage apply circuit 30, thus the charging is completed in a short period of time. Upon completing charging of the parasitic capacity, the charging-voltage apply circuit 30 is turned off, and the controlled current source 10 controls the driving current of the electron-emitting device. Accordingly, it is possible to realize a driving method which achieves quick response, and which is not likely to be influenced by voltage drop due to wiring resistance.

First Embodiment

Figure 4:
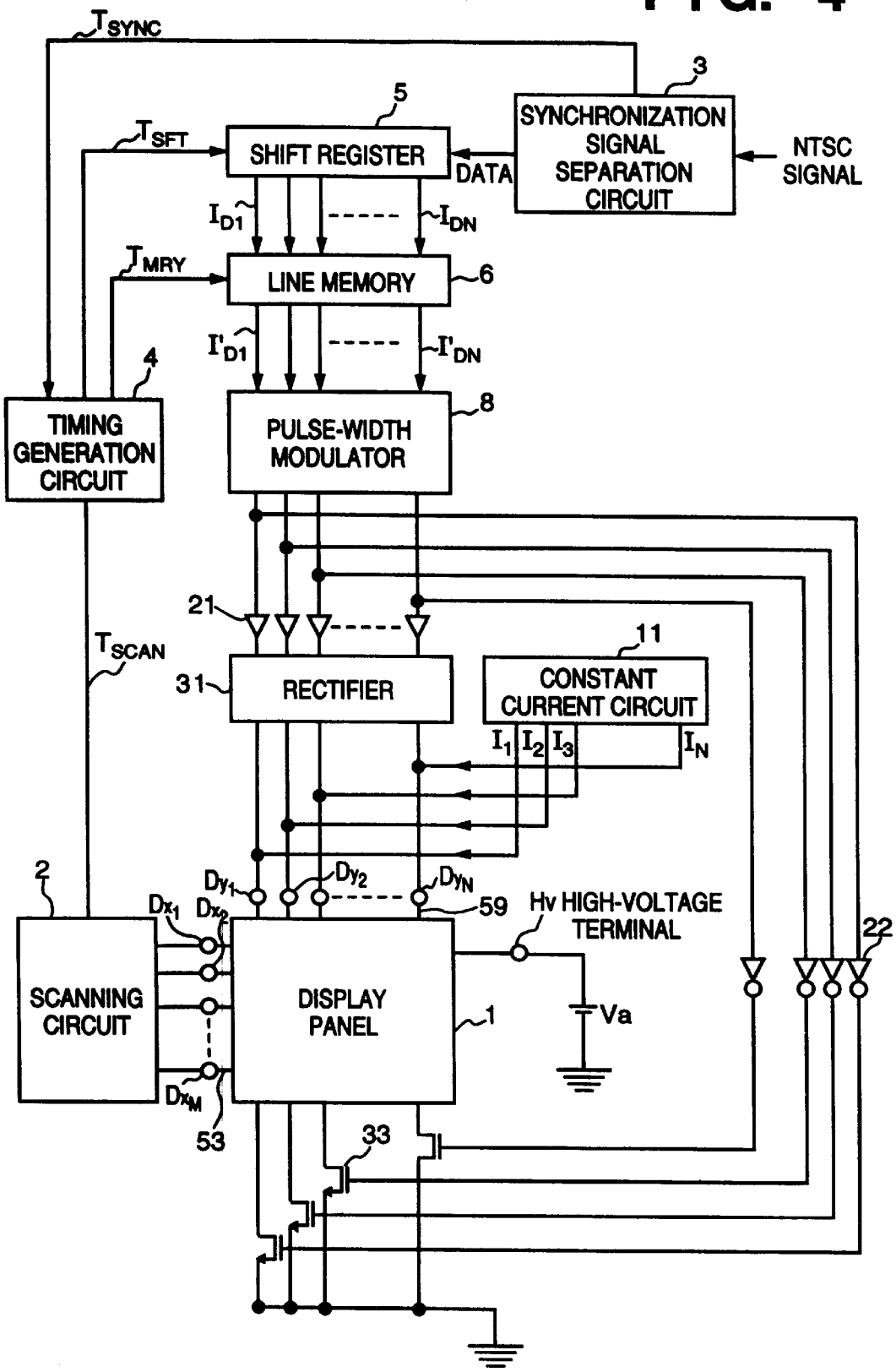
FIG. 4 is a circuit diagram according to the first embodiment.

The first embodiment applies the present invention to a display apparatus having a multi-electron-beam source. FIG. 4 is a block diagram showing a circuit structure of the embodiment. In FIG. 4, reference numeral 1 denotes a display panel including the multi-electron-beam source. Reference letters $Dx_1$ to $Dx_M$ denote connection terminals for row wiring of the multi-electron-beam source; $Dy_1$ to $Dy_N$, connection terminals for column wiring of the multi-electron-beam source; Hv, a high-voltage terminal for applying an acceleration voltage to phosphors; and Va, a high-voltage source for applying an acceleration voltage. Reference numeral 2 denotes a scanning circuit; 3, a synchronization signal separation circuit; 4, a timing generation circuit; 5, a shift register corresponding to one-scanning line of image data; 6, a line memory for storing the one line of image data; 8, a pulse-width modulator; 11, a constant current circuit; 21, a voltage amplifier; 22, an inverter; 31, a rectifier; and 33, a current switch utilizing p-channel MOS·FET.

The construction and manufacturing method of the display panel 1 and the construction, manufacturing method and characteristic of the multi-electron-beam source included therein will be described later in detail.

The correspondence of respective components in FIG. 4 and those shown in FIG. 1 is as follows: the voltage amplifier 21 corresponds to the voltage source 20; the rectifier 31 corresponds to the charging-voltage apply circuit 30; and combination of the constant current circuit 11 and the current switch 33 and the inverter 22 corresponds to the controlled current source 10.

The voltage amplifier 21 is constructed with an operational amplifier. The rectifier 31 utilizes a diode as shown in FIG. 2A. The constant current circuit 11 is constructed with a constant voltage source and a current mirror circuit.

The present embodiment is a display apparatus which displays a television signal utilizing the NTSC scheme, therefore, the embodiment is operated on the basis of an NTSC composite signal inputted from an external unit. The synchronization signal separation circuit 3 separates the NTSC composite signal into image data DATA and a synchronization signal $T_{SYNC}$. The synchronization signal $T_{SYNC}$ includes a vertical synchronizing signal and a horizontal synchronizing signal. The timing generation circuit 4 determines operation timing for each of the units on the basis of these signals. More specifically, the timing generation circuit 4 generates signals such as $T_{SFT}$ which controls operation timing of the shift register 5, $T_{MRY}$ which controls operation timing of the line memory 6, $T_{SCAN}$ which controls operation of the scanning circuit 2, and the like.

The image data separated by the synchronization signal separation circuit 3 is subjected to serial/parallel conversion by the shift register 5, and stored in the line memory 6 for a period of one horizontal scanning. The pulse-width modulator 8 outputs a voltage signal obtained by performing pulse-width modulation on the image data stored in the line memory 6.

The voltage signal is supplied to the voltage amplifier 21 and inverter 22. The voltage amplifier 21 amplifies the voltage signal up to a level of a charging voltage. The inverter 22 inverses the voltage signal and supplies it to the gate of the current switch 33.

The scanning circuit 2 outputs the selection voltage $V_s$ or non-selection voltage $V_{ns}$ to the connection terminals $Dx_1$ to $Dx_M$ in order to sequentially scan respective rows of the multi-electron-beam source, and includes M number of switches, e.g., as shown in FIG. 3. Note that it is preferable to construct these switches with transistors.

It is preferable to determine the levels of the selection voltage $V_s$ and the non-selection voltage $V_{ns}$ outputted from the scanning circuit 2, the level of output current of the constant current circuit 11, a sink voltage of the current switch 33 and an output voltage of the voltage amplifier 21, on the basis of the (applied device voltage $V_f$ vs. emission current $I_e$) characteristic and the (applied device voltage $V_f$ vs. device current $I_f$) characteristic of the cold cathode devices to be utilized.

Figure 18:
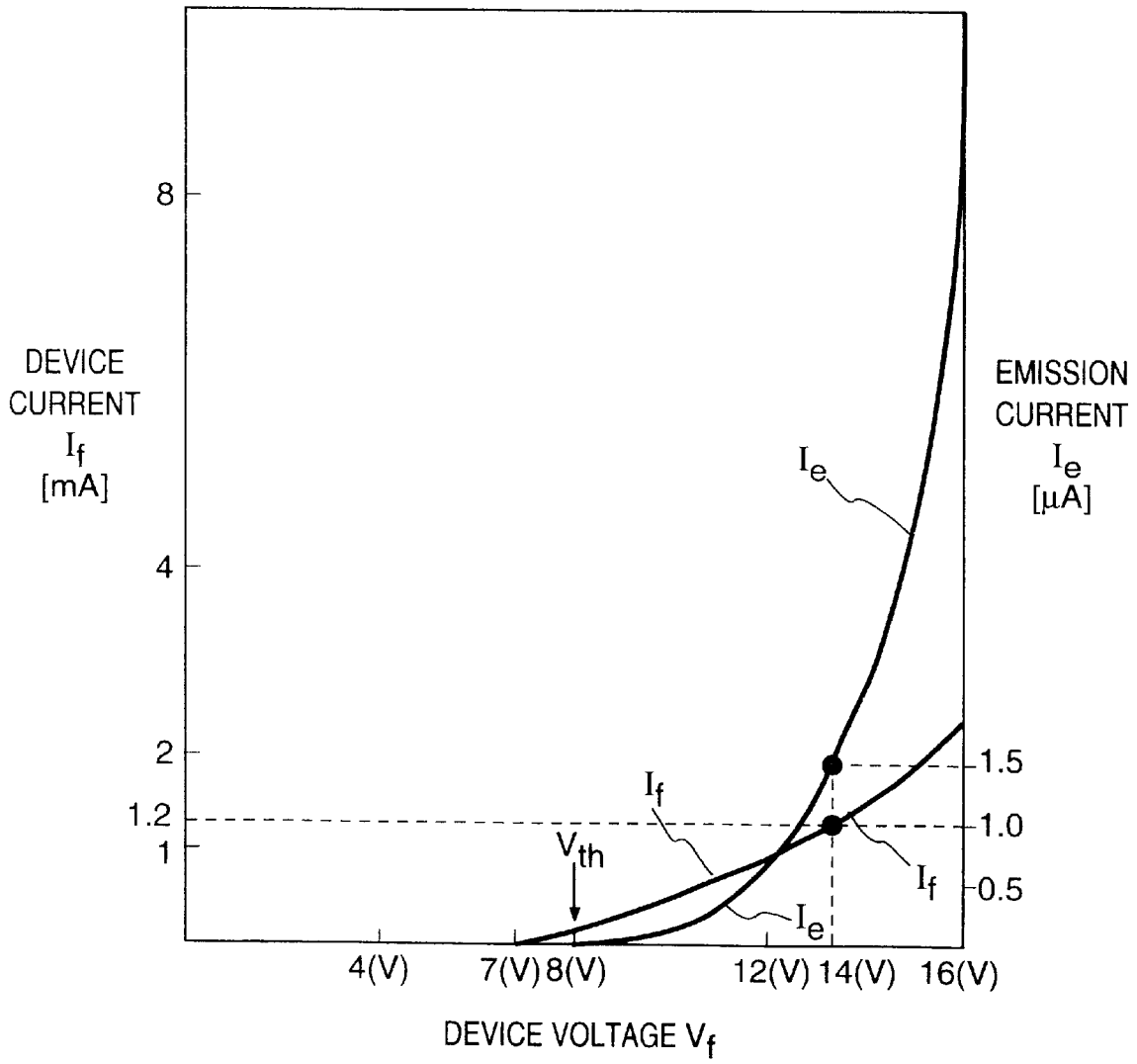
FIG. 18 is a graph showing a typical characteristic of the surface-conduction electron-emitting device utilized in the present embodiment.

The multi-electron-beam source according to the present embodiment includes surface-conduction electron-emitting devices having a characteristic shown in FIG. 18 which will be described later. Assume that the surface-conduction electron-emitting device needs to output 1.5 $\mu$A of the emission current $I_e$ in order to achieve a desired luminance in a display apparatus. In this case, as can be seen from the graph in FIG. 18 showing the characteristic, it is necessary to provide 1.2 mA of the device current $I_f$ to the surface-conduction electron-emitting devices. Therefore, the output current of the constant current circuit 11 is set at 1.5 mA. The selection voltage $V_s$ of the scanning circuit 2 is set at −7 V; and the non-selection voltage $V_{ns}$, 0 V. If there is no wiring resistance, the potential at the output portion of the constant current circuit 11 should be 7 V. (In order to provide 1.5 mA of device current $I_f$, 14 V must be provided at both ends of the device. Since the selection voltage $V_s$ is −7 V, the output potential of the constant current circuit 11 should be 7 V.) However, in practice, since there is a voltage drop in wiring, the constant current circuit operates to compensate the voltage drop. Therefore, in the case of utilizing this multi-electron-beam source, the output potential may increase to the maximum level of 7.5 V (as a matter of course, the maximum potential is subjected to change if the wiring resistance changes). Meanwhile, an electron emission threshold voltage $V_{th}$ of the surface-conduction electron-emitting device is 8 V. Therefore, so long as the non-selection voltage $V_{ns}$ is set at 0 V, an electron-beam is not emitted from the devices of unselected rows even when the output potential of the constant current circuit 11 is increased to 7.5 V.

Furthermore, the sink potential of the current switch 33 is set at 0 V (ground potential) in the embodiment shown in FIG. 3. Therefore, when the current switch 33 is turned on, the potential of row wiring becomes approximately 0 V, thus an electron-beam is not emitted from devices of the selected row or unselected rows.

Moreover, the output voltage of the voltage amplifier 21 is set as follows. It is preferable to coincide the output voltage of the voltage amplifier 21 with the maximum output potential of the constant current circuit 11, namely 7.5 V, in order to achieve charging of the parasitic capacity at high speed. However, it is safe to set the output voltage relatively low considering the possibility of risk in the electron-emitting device to which an excessive voltage may be applied because of a variance in the circuit produced in the course of manufacturing, or a variance in characteristics of the circuit due to temperature change, or a characteristic change in the circuit along with passage of time, or generation of a ringing voltage due to presence of parasitic inductance, or the like. In practice, it is preferable to set the output voltage at a value ranging between 0.5–0.9 times the maximum output potential of the current source. According to the present embodiment, it is designed such that the output voltage is 6 V, considering the voltage drop in the rectifier 31, with an assumption that voltage amplification of the voltage amplifier 21 is 6/5 (see FIGS. 5B and 5C). Note that the voltage for charging the parasitic capacity can be adjusted by changing the amplification of the voltage amplifier 21 or the number of steps of diodes, which is utilized in the rectifier 31, connected in series. Moreover, since the charging speed depends upon the response speed of the voltage amplifier, a waveform of the charging voltage can be controlled by altering the response speed of the amplifier. In addition, in a case where a DC voltage source is utilized in place of the voltage amplifier 21, it is preferable to set the output voltage relatively lower than the electron emission threshold voltage $V_{th}$ of the electron-emitting device.

Figure 5A:
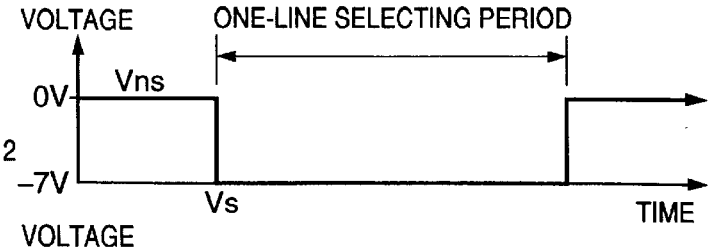
FIGS. 5A–5H are time charts for explaining a driving method according to the first embodiment.
Figure 5B:
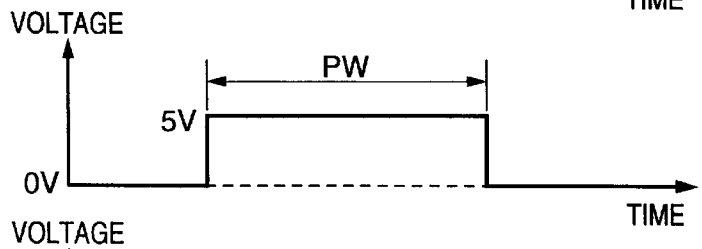

The operation of the circuit shown in FIG. 4 will be described next with reference to the time chart shown in FIG. 5. As has been described above, in the circuit shown in FIG. 4, electron-emitting devices of the multi-electron-beam source are selectively driven in the sequence of each row, by the operation of the scanning circuit 2. The graph in FIG. 5A shows a signal waveform of a voltage supplied from the scanning circuit 2 to the selected row wiring. FIG. 5B shows an example of a signal waveform outputted from the pulse-width modulator 8. The pulse-width PW is changed in accordance with a desired level of modulation. The voltage signal shown in FIG. 5B is amplified by the voltage amplifier 21, resulting in the waveform shown in FIG. 5C.

Figure 5C:
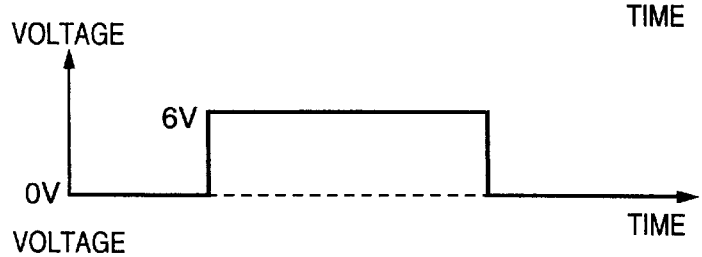
Figure 5D:
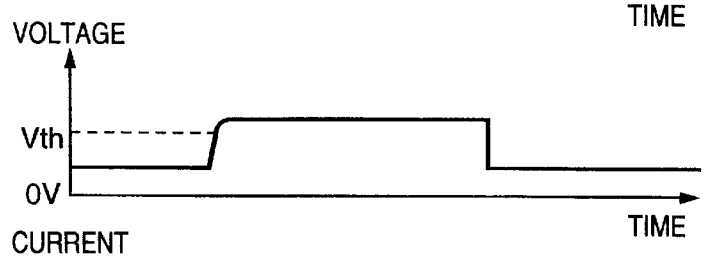
Figure 5E:
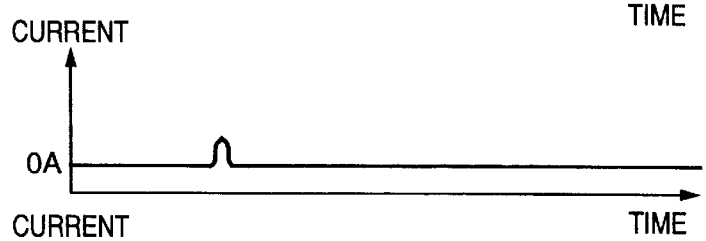

The voltage shown in FIG. 5C is applied to a column wiring via the rectifier 31. When the potential of column wiring exceeds 6 V, the rectifier 31 operates in a reversed polarity, and thus is turned off. In other words, parasitic capacity of the multi-electron-beam source is quickly charged up to approximately 6 V by the voltage application shown in FIG. 5C. The graph in FIG. 5E shows a waveform of a current for charging the parasitic capacity, supplied from the voltage amplifier 21.

Meanwhile, the waveform shown in FIG. 5B is converted to an inverse phase by the inverter 22 to control turning on/off of the current switch 33. As a result, while the pulse-width modulation signal shown in FIG. 5B is not supplied, the current switch 33 is turned on, so that the current supplied from the constant current circuit 11 is sunk to ground. Accordingly, during this phase, the current outputted from the constant current circuit 11 does not cause electron-beam emission by the electron-emitting devices. The sink current flowing to the current switch 33 is shown in the graph in FIG. 5F.

Accordingly, the output current of the constant current circuit 11 is supplied to the multi-electron-beam source as a driving current while the current switch 33 is turned off. In the present embodiment, since the parasitic capacity is charged at high speed by virtue of the voltage amplifier 21 as well as the rectifier 31, the driving current is supplied immediately to the electron-emitting devices. FIG. 5G shows a waveform of current $I_f$ provided to the electron-emitting devices. FIG. 5H shows a waveform of electron-beam output $I_e$ emitted from the electron-emitting device. Note that in FIGS. 5G and 5H, the waveforms obtained in the case of a conventional driving circuit (i.e., not including the voltage amplifier 21 and rectifier 31) is indicated with broken lines for the purpose of comparison.

According to the present embodiment, the practical response speed of the multi-electron-beam source can be improved as compared to the conventional method. Therefore, according to the display apparatus of the present embodiment, less unevenness in display luminance and a superior linearity of a grayscale are realized; and even when a moving-image is displayed, a viewer would not receive an unnatural image.

Figure 6A:
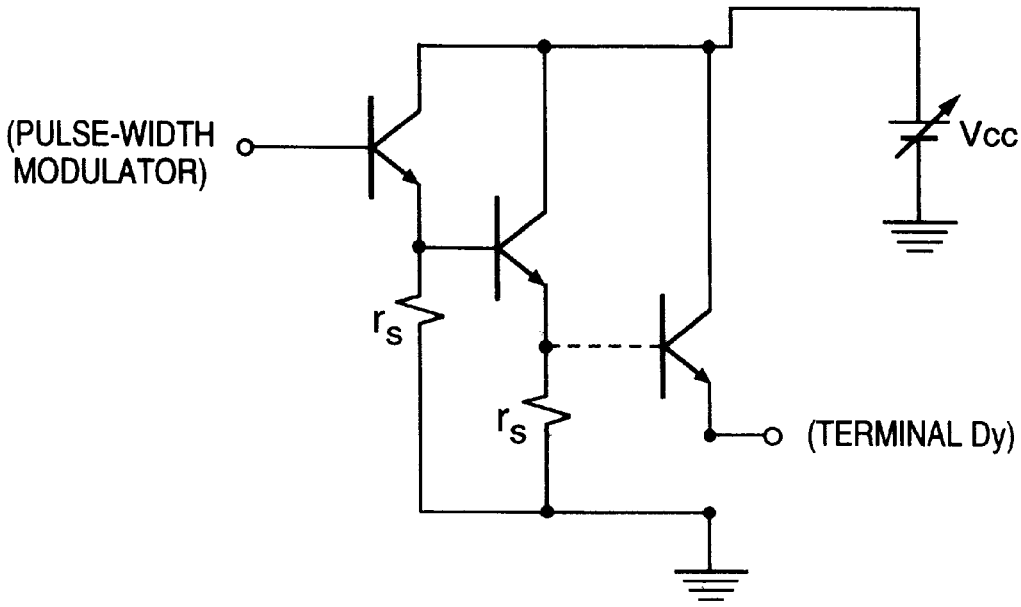
FIGS. 6A and 6B are circuit diagrams including a voltage source and a charging-voltage apply circuit.
Figure 6B:
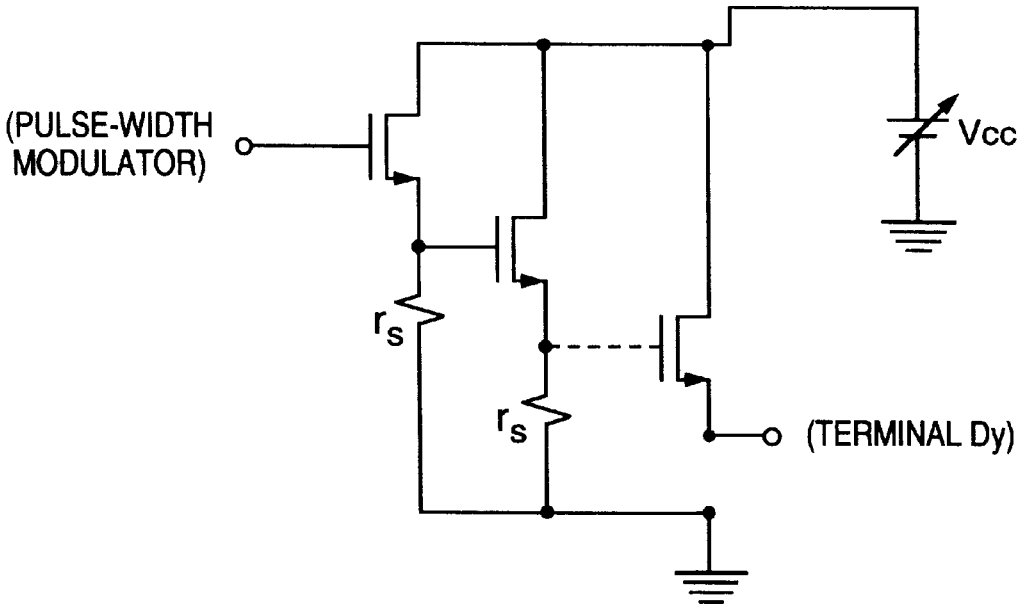

Note that the circuit shown in FIGS. 6A or 6B may be utilized in place of the rectifier 31 and voltage amplifier 21. More specifically, FIG. 6A shows a circuit combining a variable voltage source Vcc and a bipolar transistor connected in the Darlington scheme. Herein, resistance $r_s$ is connected between the base and the ground in order to increase operation speed of the transistor. FIG. 6B shows a circuit in which a MOS·FET is utilized instead of a bipolar transistor, thereby providing an advantage of low manufacturing cost.

Second Embodiment

Figure 7:
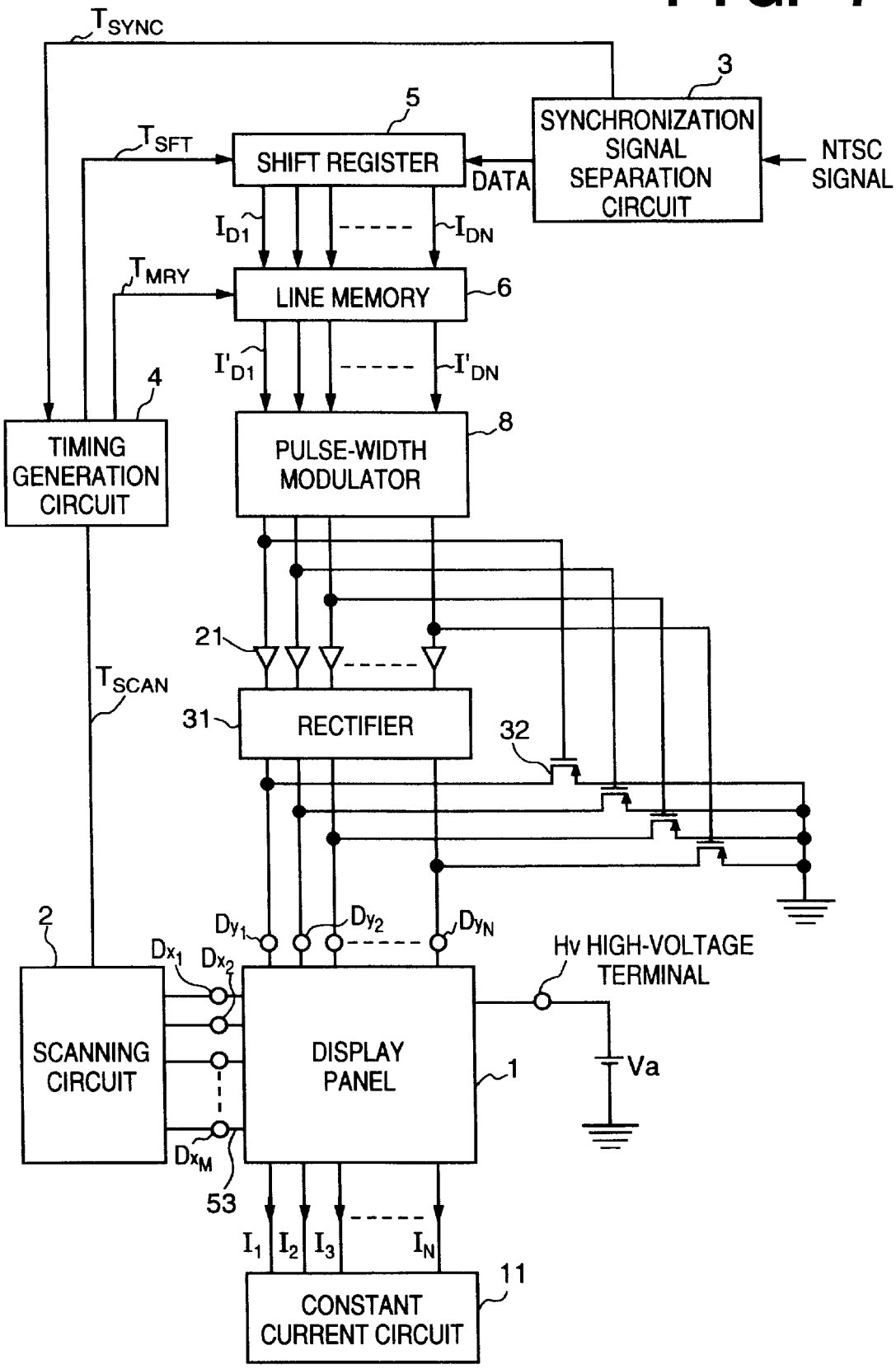
FIG. 7 is a circuit diagram according to the second embodiment.

In the second embodiment of the present invention, the direction of the driving current supplied to the multi-electron-beam source is inverted from that of the first embodiment. According to the second embodiment, the constant current circuit for drawing current is connected to the column wiring and an image signal is subjected to pulse-width modulation. FIG. 7 shows a circuit structure of the second embodiment. Reference numeral 32 denotes p-channel MOS transistors which switch on/off the constant current ($I_1, I_2, I_3, \ldots I_N$) outputted from the constant current circuit 11 to be provided to the column wiring. The pulse-width modulator 8 outputs pulse-width signals ($PW_1$–$PW_N$) to the voltage amplifier (level shift circuit) 21 and the p-channel MOS transistors 32. Only during the period within which the pulse-width modulator 8 outputs a signal Lo-level, the transistors 32 bring the potential of column wirings down to the GND and leads the output current ($I_1$–$I_N$) of the constant current circuit 11 to the GND via the transistors 32. Therefore, the potential of the column wiring becomes 0 V during the period within which the pulse-width modulator 8 outputs Lo-level. Meanwhile, during the period within which the pulse-width modulator 8 outputs a signal Hi-level, the transistors 32 are turned off, thus the output current ($I_1$–$I_N$) of the constant current circuit 11 is provided to the electron-emitting devices.

Figure 8A:
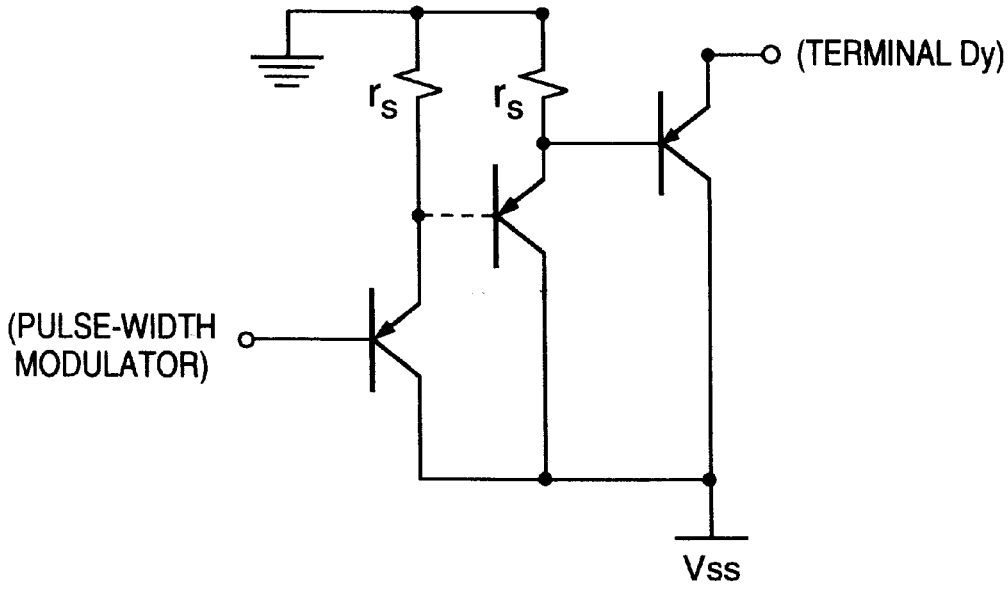
FIGS. 8A and 8B are circuit diagrams including a voltage source and a charging-voltage apply circuit.
Figure 8B:
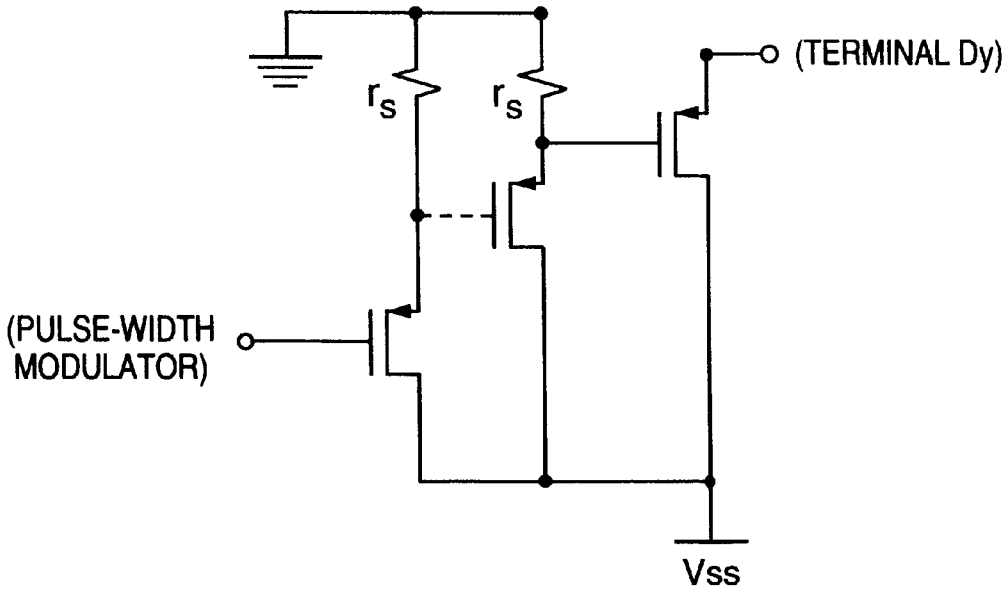

Note that in the second embodiment, the voltage polarity of the voltage amplifier 21 and rectifier 31 is reversed from that of the first embodiment. Therefore, the rectifier 31 and the voltage amplifier 21 in the present embodiment may be substituted with the circuits shown in FIGS. 8A and 8B. FIG. 8A shows a circuit combining a variable voltage source Vss and a bipolar transistor connected in the Darlington scheme. Herein, resistance $r_s$ is connected between the base and the ground in order to increase operation speed of the transistor. FIG. 8B shows a circuit in which a MOS·FET is utilized instead of a bipolar transistor, thereby providing an advantage of low manufacturing cost.

Similar to the first embodiment, the second embodiment also achieves high-speed charging of the parasitic capacity, realizing quicker response of the electron-emitting devices as compared to the conventional method.

In other words, according to the second embodiment, the practical response speed of the multi-electron-beam source can be improved as compared to the conventional method. Therefore, according to a display apparatus of the second embodiment, less unevenness in display luminance and a superior linearity of a grayscale are realized; and even when a moving-image is displayed, a viewer would not receive an unnatural image.

Third Embodiment

Figure 9:
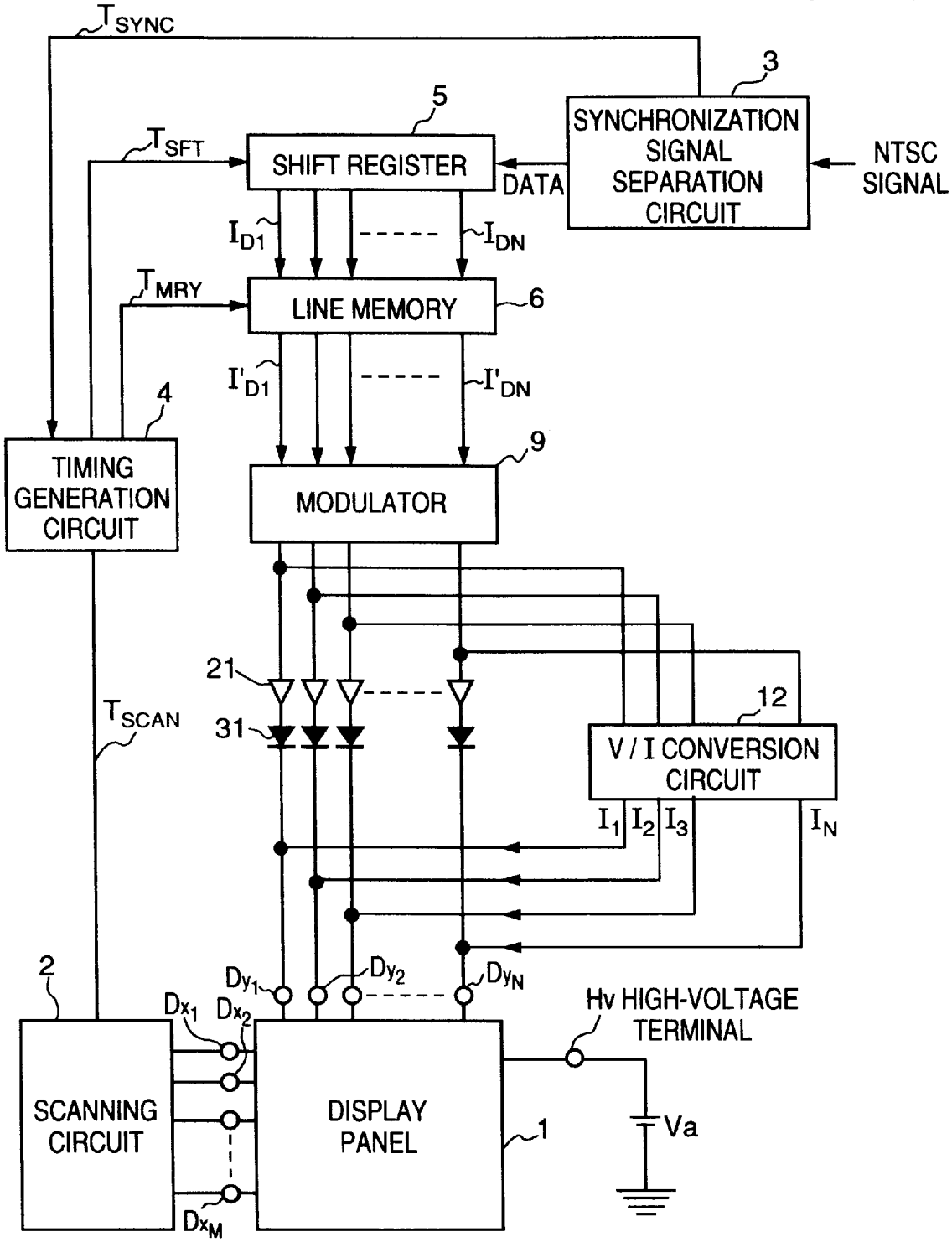
FIG. 9 is a circuit diagram according to the third embodiment.
Figure 10A:
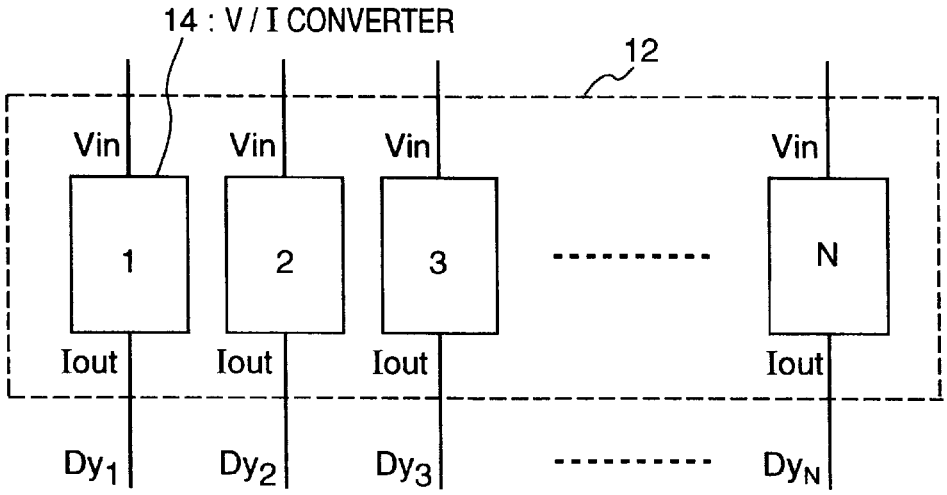
FIGS. 10A and 10B are diagrams for explaining a V/I converter utilized in the third embodiment.
Figure 10B:
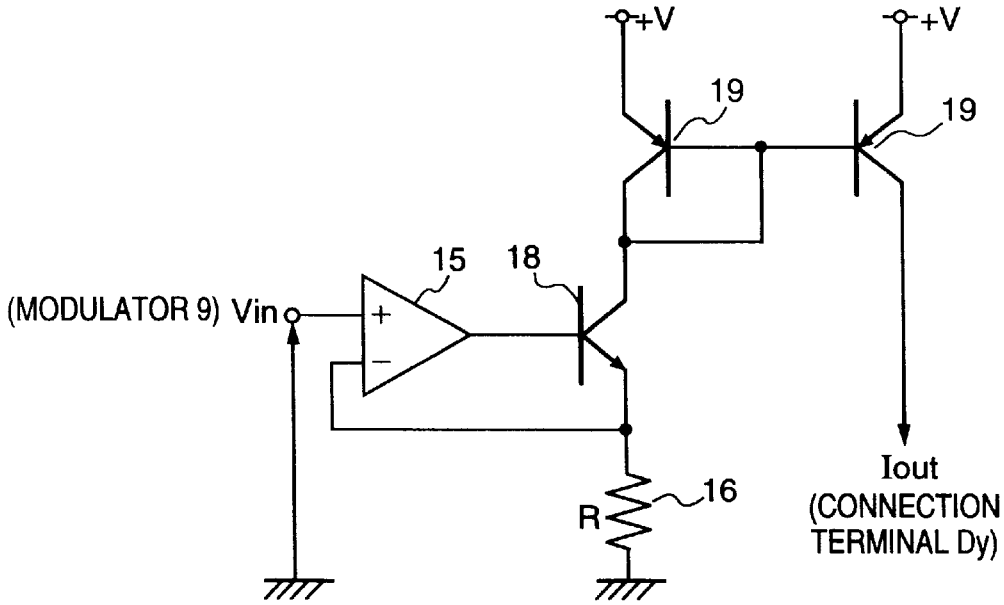

According to the third embodiment of the present invention, a V/I conversion circuit is utilized as the controlled current source 10 in FIG. 1. FIG. 9 shows a circuit structure of the third embodiment. In FIG. 9, reference numeral 12 denotes a V/I conversion circuit. The V/I conversion circuit 12 includes N number of V/I converters 14 as shown in FIG. 10A. It is preferable to construct each of the V/I converters 14 with a current mirror circuit as shown in FIG. 10B. The circuit structure in FIG. 9 has an advantage of being suitable for either a pulse-width modulation method or an amplitude modulation method. Therefore, the same pulse-width modulator used in the first embodiment may serve as a modulator 9, or an amplitude modulator may be utilized. The same voltage amplifier 21 and the rectifier 31 as that in the first embodiment are utilized in the third embodiment.

Similar to the first embodiment, the third embodiment also achieves high-speed charging of the parasitic capacity, realizing quicker response of the electron-emitting devices as compared to the conventional method.

In other words, according to the third embodiment, the practical response speed of the multi-electron-beam source can be improved as compared to the conventional method. Therefore, according to a display apparatus of the third embodiment, less unevenness in display luminance and a superior linearity of a grayscale are realized; and even when a moving-image is displayed, a viewer would not receive an unnatural image.

<Arrangement and Manufacturing Method of Display Panel>

The arrangement and manufacturing method of the display panel 1 of the image display apparatus according to the first to third embodiments of the present invention will be described below providing detailed examples.

Figure 11:
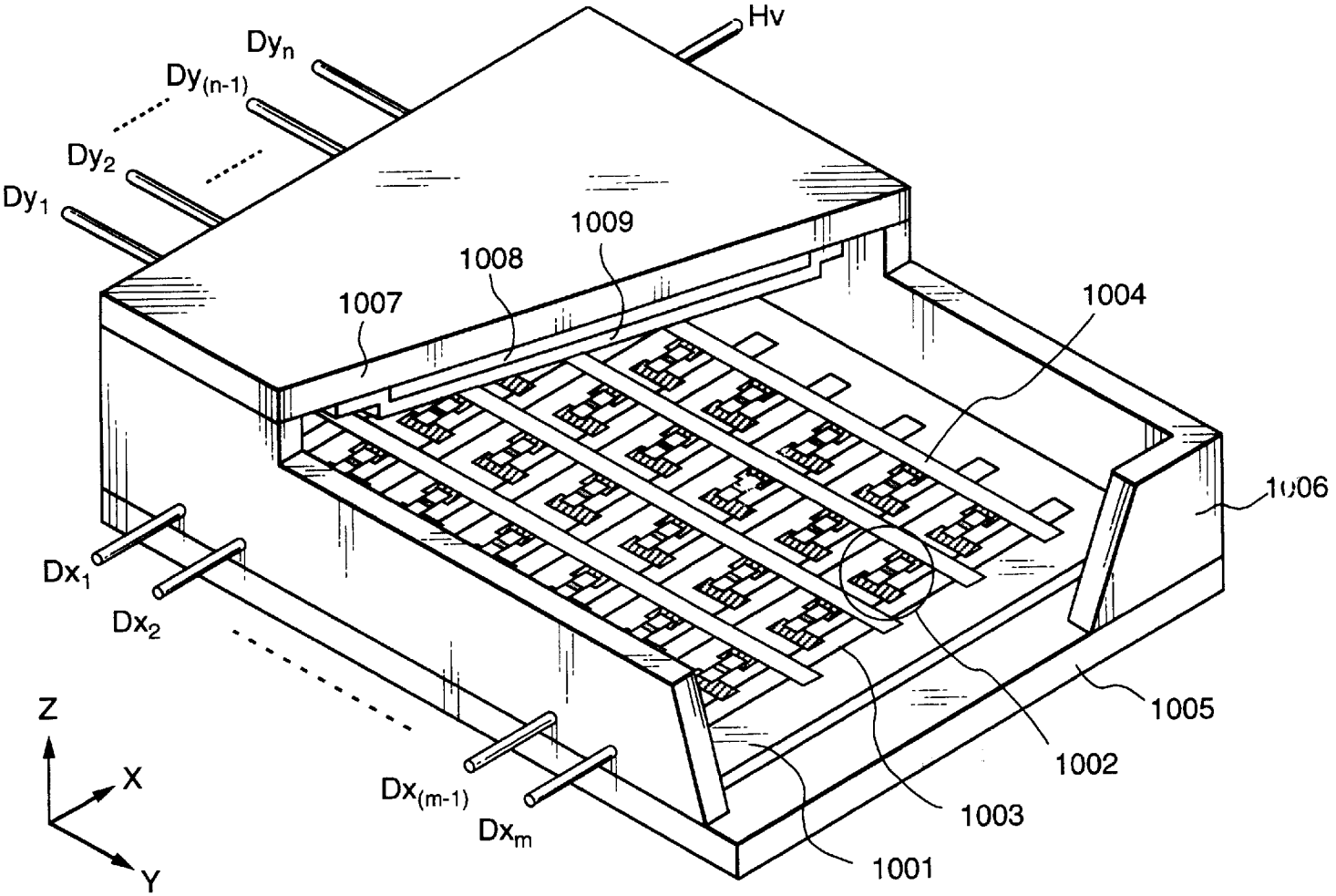
FIG. 11 is a perspective view showing an image display apparatus according to the present embodiment where a part of the display panel is cut away.

FIG. 11 is a partially cutaway perspective view of a display panel used in the embodiments, showing the internal structure of the panel.

Referring to FIG. 11, reference numeral 1005 denotes a rear plate; 1006, a side wall; and 1007, a face plate. These parts 1005 to 1007 form an airtight vessel for maintaining a vacuum in the display panel. To construct the airtight vessel, it is necessary to seal-connect the respective parts to allow their junction portions to hold sufficient strength and airtight condition. For example, frit glass is applied to the junction portions and sintered at 400° C. to 500° C. in air or a nitrogen atmosphere for 10 minutes or more, thereby seal-connecting the parts. A method of evacuating the airtight vessel will be described later.

The rear plate 1005 has a substrate 1001 fixed thereon, on which N×M cold cathode devices 1002 are formed. (N and M are positive integers of 2 or more and appropriately set in accordance with a target number of display pixels. For example, in a display apparatus for high-definition television display, preferably N=3,000 or more, and M=1,000 or more. In this embodiment, N=3,072, and M=1,024.) The N×M cold cathode devices are arranged in a simple matrix with M number of row wirings 1003 and N number of column wirings 1004. The portion constituted by the substrate 1001, the cold cathode devices 1002, the row wiring 1003, and the column wiring 1004 will be referred to as a multi-electron-beam source. The manufacturing method and structure of the multi-electron-beam source will be described later in detail.

In this embodiment, the substrate 1001 of the multi-electron-beam source is fixed to the rear plate 1005 of the airtight vessel. However, if the substrate 1001 of the multi-electron-beam source has a sufficient strength, the substrate 1001 itself of the multi-electron-beam source may be used as the rear plate of the airtight vessel.

Figure 12A:
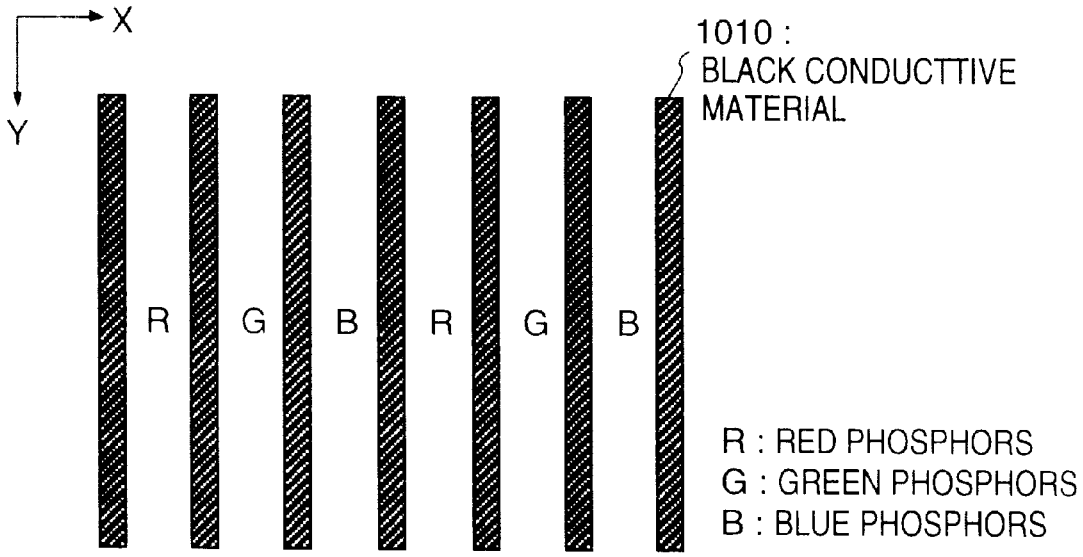
FIGS. 12A and 12B are plan views exemplifying an arrangement of phosphors used in a face plate of a display panel.

Furthermore, a phosphor film 1008 is formed on the lower surface of the face plate 1007. As the display panel of the present embodiment is a color display panel, the phosphor film 1008 is coated with red (R), green (G), and blue (B) phosphors, i.e., three primary color phosphors used in the CRT field. As shown in FIG. 12A, the R, G, and B phosphors are applied in a striped arrangement. A black conductive material 1010 is provided between the stripes of the phosphors. The purpose of providing the black conductive material 1010 is to prevent display color misregistration even if the electron beam irradiation position is shifted to some extent, to prevent degradation of display contrast by shutting off reflection of external light, to prevent charge-up of the phosphor film 1008 by electron beams, and the like. The black conductive material 1010 mainly consists of graphite, though any other material may be used as long as the above purpose can be attained.

Figure 12B:
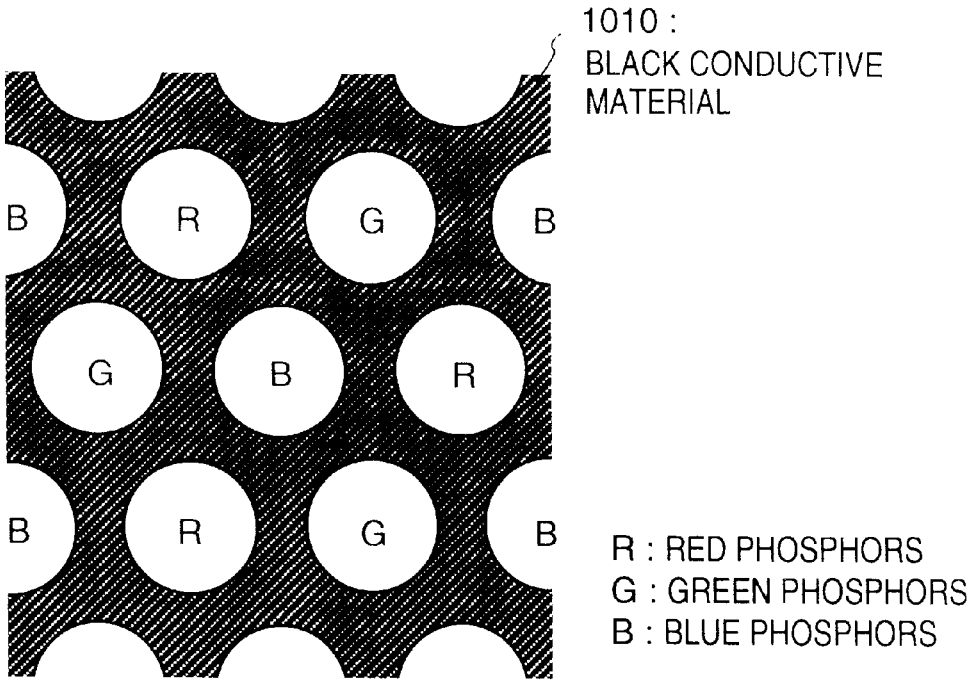

The arrangement of the phosphors of the three primary colors, i.e., R, G, and B is not limited to the striped arrangement shown in FIG. 12A. For example, a delta arrangement shown in FIG. 12B or other arrangements may be employed.

When a monochromatic display panel is to be formed, a monochromatic phosphor material must be used for the phosphor film 1008. In this case, the black conductive material 1010 need not always be used.

Furthermore, a metal back 1009, which is well-known in the CRT field, is provided on the rear plate side surface of the phosphor film 1008. The purpose of providing the metal back 1009 is to improve the light-utilization ratio by mirror-reflecting part of the light emitted from the phosphor film 1008, to protect the phosphor film 1008 from collision with negative ions, to use the metal back 1009 as an electrode for applying an electron beam accelerating voltage, to use the metal back 1009 as a conductive path of electrons which excited the phosphor film 1008, and the like. The metal back 1009 is formed by forming the phosphor film 1008 on the face plate 1007, applying a smoothing process to the phosphor film surface, and depositing aluminum (Al) thereon by vacuum deposition. Note that when a phosphor material for a low voltage is used for the phosphor film 1008, the metal back 1009 is not used.

Furthermore, although not utilized in the above-described embodiments, transparent electrodes made of, e.g., ITO may be provided between the face plate 1007 and the phosphor film 1008, for application of an accelerating voltage or for improving the conductivity of the phosphor film.

Moreover, referring to FIG. 11, reference symbols $Dx_1$ to $Dx_M$, $Dy_1$ to $Dy_N$, and Hv denote electric connection terminals for an airtight structure provided to electrically connect the display panel to an electric circuit (not shown). The terminals $Dx_1$ to $Dx_M$; are electrically connected to the row wirings 1003 of the multi-electron-beam source; the terminals $Dy_1$ to $Dy_N$, to the column wirings 1004 of the multi-electron-beam source; and the terminal Hv, to the metal back 1009 of the face plate 1007.

In order to evacuate the interior of the airtight vessel, an exhaust pipe and a vacuum pump, not shown, are connected after the airtight vessel is assembled and the interior of the vessel is exhausted to a vacuum of $10^{-7}$ Torr. The exhaust pipe is then sealed. In order to maintain the degree of vacuum within the airtight vessel, a getter film (not shown) is formed at a prescribed position inside the airtight vessel immediately before or immediately after the pipe is sealed. The getter film is a film formed by heating a getter material, the main ingredient of which is Ba, for example, by a heater or high-frequency heating to deposit the material. A vacuum on the order of $1\times10^{-5}$ to $1\times10^{-7}$ Torr is maintained inside the airtight vessel by the adsorbing action of the getter film.

The foregoing descriptions have been provided with respect to the arrangement and manufacturing method of the display panel according to the present embodiments.

A method of manufacturing the multi-electron-beam source 50 used in the display panel of the above-described embodiments will be described next. If the multi-electron-beam source used in the image display apparatus of this invention is an electron source having cold cathode devices wired in a simple matrix, there is no limitation upon the material, shape or method of manufacturing of the cold cathode devices. Accordingly, it is possible to use cold cathode devices such as surface-conduction electron-emitting devices or cold cathode devices of the FE or MIM-type.

Since there is demand for inexpensive display devices having a large display screen, the surface-conduction electron-emitting devices are particularly preferred as the cold cathode devices. More specifically, with the FE-type device, the relative positions of the emitter cone and gate electrode and the shape thereof greatly influence the electron emission characteristics. Consequently, a highly precise manufacturing technique is required. This is a disadvantage in terms of enlarging surface area and reducing the manufacturing cost. With the MIM-type device, it is required that the insulating layer and film thickness of the upper electrode be made uniformly even if they are thin. This also is a disadvantage in terms of enlarging surface area and lowering the cost of manufacture. In this respect, the surface-conduction electron-emitting device is comparatively simple to manufacture, the surface area thereof is easy to enlarge and the cost of manufacture can be reduced with ease. Further, the inventors have discovered that, among the surface-conduction electron-emitting devices available, a device whose electron emission portion or peripheral portion is formed from a film of fine particles excels in its electron emission characteristics, and that the device can be manufactured easily. Accordingly, it may be construed that such a device is most preferred for use in a multi-electron-beam source of an image display apparatus having a high luminance and a large display screen. Accordingly, the display panel of the foregoing embodiments utilizes a surface-conduction electron-emitting device whose electron emission portion or peripheral portion was formed from a film of fine particles. First, therefore, the basic construction, method of manufacturing and characteristics of an ideal surface-conduction electron-emitting device will be described, and this will be followed by a description of the structure of a multi-electron-beam source in which a large number of devices are wired in the form of a simple matrix.

<Preferred Structure and Manufacturing Method of Surface-Conduction Electron-Emitting Device>

The typical structure of the surface-conduction electron-emitting device, having an electron-emitting portion or its peripheral portion made of a fine particle film, includes a plane type structure and a step type structure.

<Plane Type Surface-Conduction Electron-Emitting Device>

Figure 13A:
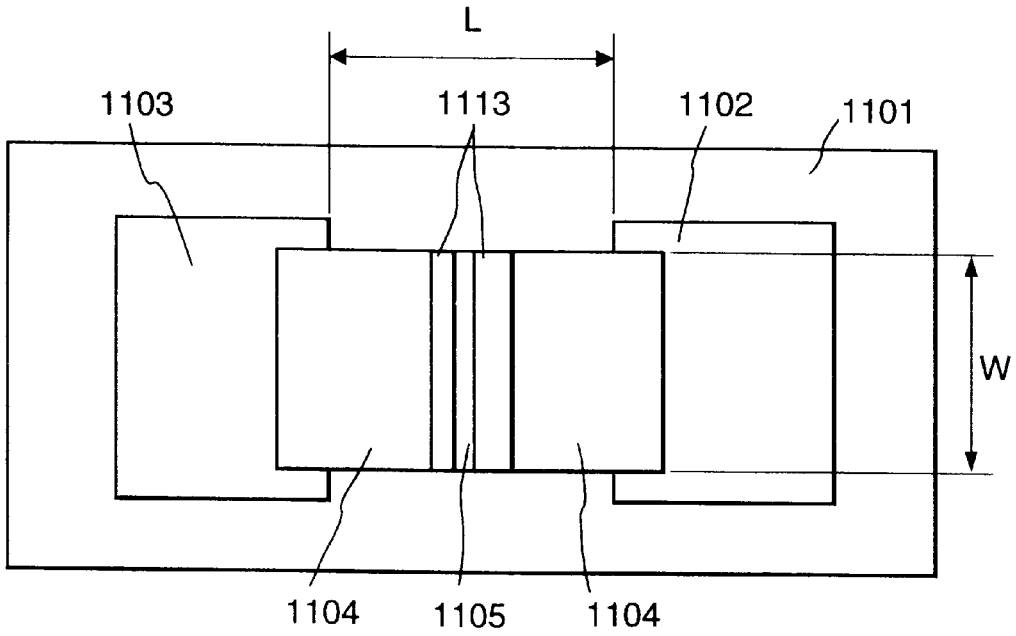
FIG. 13A is a plan view of a plane type surface-conduction electron-emitting device utilized in the present embodiment.
Figure 13B:
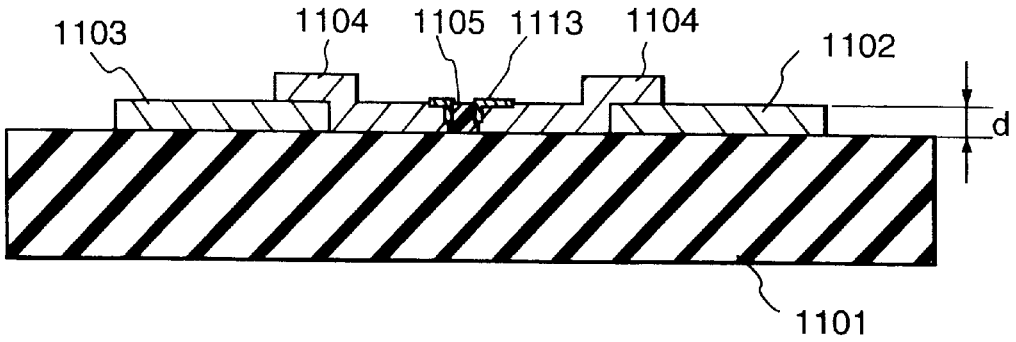
FIG. 13B is a sectional view of the plane type surface-conduction electron-emitting device utilized in the present embodiment.

The structure and manufacturing method of a plane type surface-conduction electron-emitting device will be described first. FIGS. 13A and 13B are plan and sectional views for explaining the structure of the plane type surface-conduction electron-emitting device. Referring to FIGS. 13A and 13B, reference numeral 1101 denotes a substrate; 1102 and 1103, device electrodes; 1104, a conductive thin film; 1105, an electron-emitting portion formed by an energization forming process; and 1113, a thin film formed by an activation process.

As the substrate 1101, various glass substrates of, e.g., silica glass and soda-lime glass, various ceramic substrates of, e.g., alumina, or any of those substrates with an insulating layer consisting of, e.g., $SiO_2$ formed thereon can be employed.

The device electrodes 1102 and 1103 are formed on the substrate 1101 to be parallel to its surface, are formed opposite to each other, are made of a conductive material. For example, one of the following materials may be selected and used: metals such as Ni, Cr, Au, Mo, W, Pt, Ti, Cu, Pd, and Ag, alloys of these materials, metal oxides such as $In_2O_3$—$SnO_2$, and semiconductors such as polysilicon. The device electrodes can be easily formed by the combination of a film-forming technique such as vacuum deposition and a patterning technique such as photolithography or etching, however, any other method (e.g., a printing technique) may be employed.

The shape of the device electrodes 1102 and 1103 is appropriately designed in accordance with an application purpose of the electron-emitting device. Generally, an electrode spacing L is designed to be an appropriate value in a range from several hundreds Å to several hundreds $\mu$m. The most preferable range for a display apparatus is from several $\mu$m to several tens $\mu$m. As for a thickness d of the device electrodes, an appropriate value is generally selected from a range from several hundreds Å to several $\mu$m.

The conductive thin film 1104 is made of a fine particle film. The "fine particle film" is a film which contains a large number of fine particles (including an insular aggregate). Normally, microscopic observation of the fine particle film reveals that the individual fine particles in the film are spaced apart from each other, or adjacent to each other, or overlap each other.

One particle in the fine particle film has a diameter within a range from several Å to several thousands Å. Preferably, the diameter falls within a range from 10 Å to 200 Å. The thickness of the fine particle film is appropriately set in consideration of the following conditions: a condition necessary for electrical connection to the device electrode 1102 or 1103, a condition for the energization forming process to be described later, a condition for setting the electric resistance of the fine particle film itself to an appropriate value to be described later, and so on. More specifically, the thickness of the film is set in a range from several Å to several thousands Å, and more preferably, 10 Å to 500 Å.

For example, materials used for forming the fine particle film are metals such as Pd, At, Ru, Ag, Au, Ti, In, Cu, Cr, Fe, Zn, Sn, Ta, W, and Pb, oxides such as PdO, $SnO_2$, $In_2O_3$, PbO, and $Sb_2O_3$, borides such as $HfB_2$, $ZrB_2$, $LaB_6$, $CeB_6$, $YB_4$, and $GdB_4$, carbides such as TiC, ZrC, HfC, TaC, SiC, and WC, nitrides such as TiN, ZrN, HEN, semiconductors such as Si and Ge, and carbons. An appropriate material is selected from these materials.

As described above, the conductive thin film 1104 is formed using a fine particle film, and the sheet resistance of the film is set to fall within a range from $10^3$ to $10^7$ Ω/sq.

Since it is preferable that the conductive thin film 1104 is electrically well-connected to the device electrodes 1102 and 1103, they are arranged so as to partly overlap each other. Referring to FIGS. 13A and 13B, the respective parts are stacked in the following order from the bottom: the substrate, the device electrodes, and the conductive thin film. The overlapping order may be: the substrate, the conductive thin film, and the device electrodes, from the bottom.

The electron-emitting portion 1105 is a fissure portion formed at a part of the conductive thin film 1104. The electron-emitting portion 1105 has an electric resistance higher than that of the peripheral conductive thin film. The fissure portion is formed by the energization forming process (to be described later) performed on the conductive thin film 1104. In some cases, particles, having a diameter of several Å to several hundreds Å, are arranged within the fissure portion. As it is difficult to exactly illustrate the actual position and shape of the electron-emitting portion, FIGS. 13A and 13B show the fissure portion schematically.

The thin film 1113, which consists of carbon or a carbon compound, covers the electron-emitting portion 1105 and its peripheral portion. The thin film 1113 is formed by the activation process to be described later after the energization forming process.

The thin film 1113 is preferably made of monocrystalline graphite, polycrystalline graphite, amorphous carbon, or a mixture thereof, and its thickness is 500 Å or less, and more particularly, 300 Å or less.

As it is difficult to exactly illustrate the actual position or shape of the thin film 1113, FIGS. 13A and 13B show the film schematically. FIG. 13A is a plan view showing the device in which a part of the thin film 1113 is removed.

The preferred basic structure of the device has been described above. In the present embodiments, actually, the following device is used.

The substrate 1101 consists of soda-lime glass, and the device electrodes 1102 and 1103, an Ni thin film. The thickness d of the device electrodes is 1,000 Å, and the electrode spacing L is 2 μm. As the main material for the fine particle film, Pd or PdO is used. The thickness and width W of the fine particle film are respectively set to about 100 Å and 100 μm.

A preferred method of manufacturing the plane type surface-conduction electron-emitting device will be described next. FIGS. 14A to 14E are sectional views for explaining steps of manufacturing the plane type surface-conduction electron-emitting device. The same reference numerals as in FIGS. 13A and 13B are assigned in FIGS. 14A to 14E, and a detailed description thereof will be omitted.

Figure 14A:
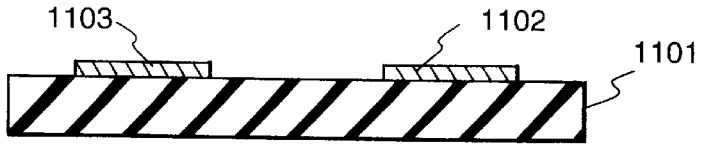
FIGS. 14A to 14E are sectional views showing steps of manufacturing the plane type surface-conduction electron-emitting device.

(1) First, as shown in FIG. 14A, the device electrodes 1102 and 1103 are formed on the substrate 1101.

In forming the device electrodes 1102 and 1103, the substrate 1101 is fully cleaned with a detergent, pure water, and an organic solvent, and a material for the device electrodes is deposited on the substrate 1101. (As a depositing method, a vacuum film-forming technique such as vapor deposition or sputtering may be used.) Thereafter, the deposited electrode material is patterned by a photolithographic etching technique, thus forming the pair of device electrodes (1102 and 1103) in FIG. 14A.

Figure 14B:
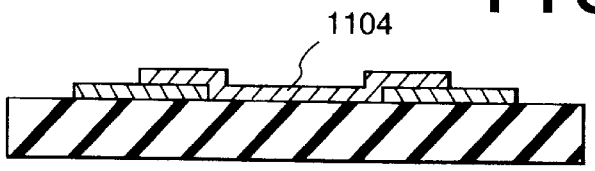

(2) Next, as shown in FIG. 14B, the conductive thin film 1104 is formed.

In forming the conductive thin film, an organic metal solution is applied to the substrate 1101 prepared in FIG. 14A first, and the applied solution is then dried and sintered, thereby forming a fine particle film. Thereafter, the fine particle film is patterned into a predetermined shape by the photolithographic etching method. The organic metal solution may be an organic metal compound solution containing a material for the fine particles, used for the conductive thin film, as a main element. (In this embodiment, Pd is used as the main element. In this embodiment, application of an organic metal solution is performed by a dipping method, however, a spinner method or spraying method may be used.)

As a method of forming the conductive thin film made of the fine particle film, the application of an organic metal solution used in this embodiment can be replaced with any other method such as a vacuum deposition method, a sputtering method, or a chemical vapor deposition method.

Figure 14C:
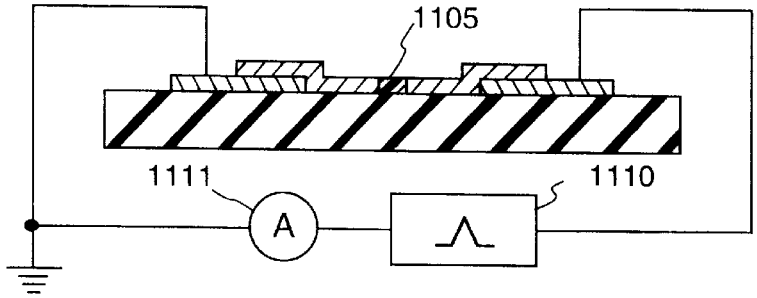

(3) As shown in FIG. 14C, an appropriate voltage is applied between the device electrodes 1102 and 1103, from a power supply 1110 for the energization forming process, and the energization forming process is performed to form the electron-emitting portion 1105.

The energization forming process here is a process of performing electrification for the conductive thin film 1104 made of a fine particle film to appropriately destroy, deform, or deteriorate a part of the conductive thin film, thereby changing the film into a structure suitable for electron emission. In the conductive thin film made of the fine particle film, the portion changed into the structure suitable for electron emission (i.e., the electron-emitting portion 1105) has an appropriate fissure in the thin film. Comparing the thin film having the electron-emitting portion 1105 with the thin film before the energization forming process, the electric resistance measured between the device electrodes 1102 and 1103 has greatly increased.

Figure 15:
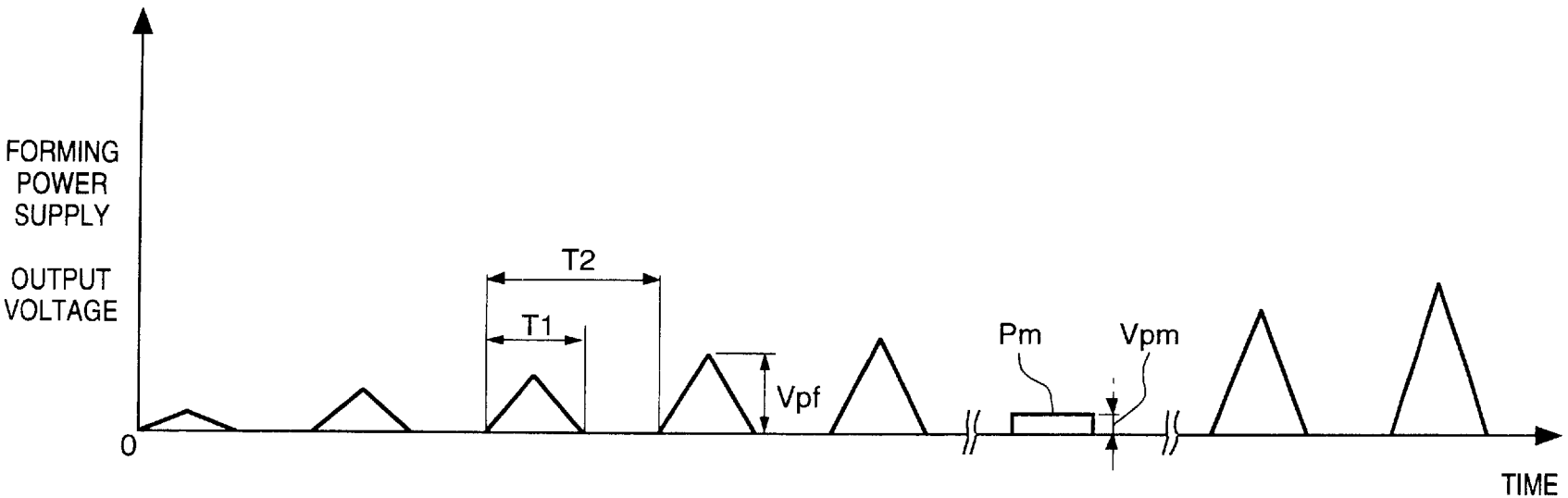
FIG. 15 is a graph showing a waveform of applied voltage in an energization forming process.

An electrification method for the energization forming process will be described in detail with reference to FIG. 15 showing an example of the waveform of an appropriate voltage applied from the power supply 1110 for the energization forming process. In the energization forming process to the conductive thin film made of a fine particle film, a pulse-like voltage is preferably employed. In this embodiment, as shown in FIG. 15, a triangular pulse having a pulse width T1 is continuously applied at a pulse interval T2. In this case, a peak value Vpf of the triangular pulse is progressively increased. Furthermore, a monitor pulse Pm is inserted between the triangular pulses at appropriate intervals to monitor the formed state of the electron-emitting portion 1105, and the current that flows at the insertion is measured by an ammeter 1111.

In this embodiment, e.g., in a $10^{-5}$ Torr vacuum atmosphere, the pulse width T1 is set to 1 msec; and the pulse interval T2, to 10 msec. The peak value Vpf is increased by 0.1 V, at each pulse. Each time five triangular pulses are applied, one monitor pulse Pm is inserted. To avoid adverse effects on the energization forming process, a voltage Vpm of the monitor pulse is set to 0.1 V. When the electric resistance between the device electrodes 1102 and 1103 becomes $1\times10^{6}$ ΩÅ, i.e., the current measured by the ammeter 1111 upon application of the monitor pulse becomes $1\times10^{-7}$ A or less, electrification for the energization forming process is terminated.

Note that the above method is preferable to the surface-conduction electron-emitting device of this embodiment. In the case of changing the design of the surface-conduction electron-emitting device concerning, e.g., the material or thickness of the fine particle film, or the spacing L between the device electrodes, the conditions for electrification are preferably changed in accordance with the change in device design.

Figure 14D:
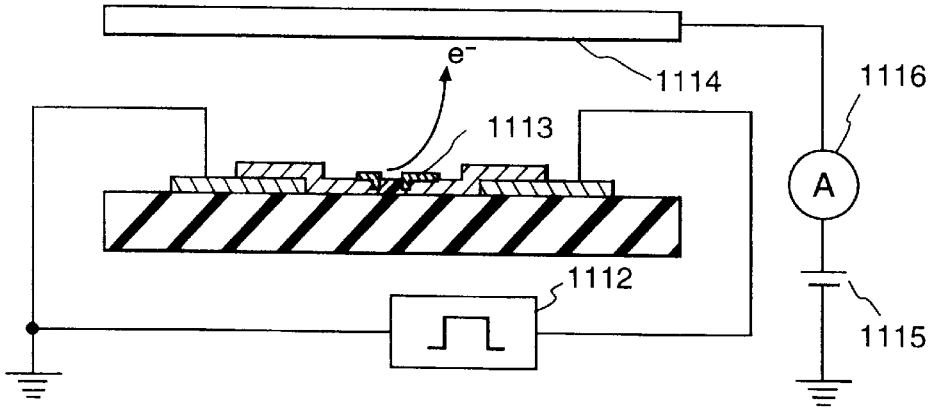

(4) As shown in FIG. 14D, an appropriate voltage is applied next, from an activation power supply 1112, between the device electrodes 1102 and 1103, and the activation process is performed to improve the electron-emitting characteristics.

The activation process here is a process of performing electrification of the electron-emitting portion 1105 formed by the energization forming process, under appropriate conditions, to deposit a carbon or carbon compound around the electron-emitting portion 1105. (FIG. 14D shows the deposited material of the carbon or carbon compound as the material 1113.) Comparing the electron-emitting portion 1105 with that before the activation process, the emission current at the same applied voltage can be increased typically about 100 times or more.

The activation process is performed by periodically applying a voltage pulse in a $10^{-4}$ to $10^{-5}$ Torr vacuum atmosphere to deposit a carbon or carbon compound mainly derived from an organic compound existing in the vacuum atmosphere. The deposition material 1113 is any of monocrystalline graphite, polycrystalline graphite, amorphous carbon, and a mixture thereof. The thickness of the deposition material 1113 is 500 Å or less, and more preferably, 300 Å or less.

Figure 16A:
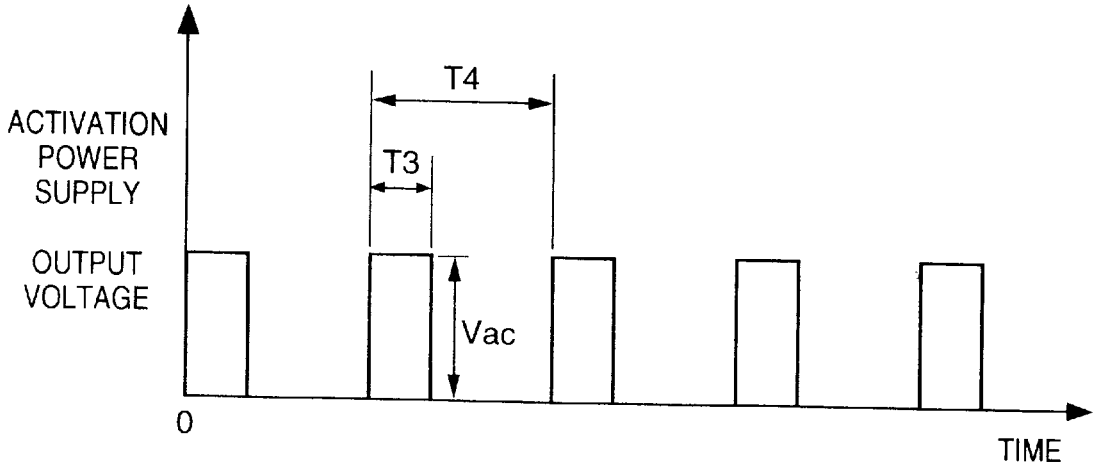
FIG. 16A is a graph showing a waveform of applied voltage in an activation process.

FIG. 16A shows an example of the waveform of an appropriate voltage applied from the activation power supply 1112 so as to explain the electrification method in more detail. In this embodiment, the activation process is performed by periodically applying a constant voltage having a rectangular waveform. More specifically, the voltage Vac having a rectangular waveform is set to 14 V; a pulse width T3, to 1 msec; and a pulse interval T4, to 10 msec. Note that the above electrification conditions are preferable to manufacture the surface-conduction electron-emitting device of this embodiment. When the design of the surface-conduction electron-emitting device is changed, the conditions are preferably changed in accordance with the change in device design.

Figure 16B:
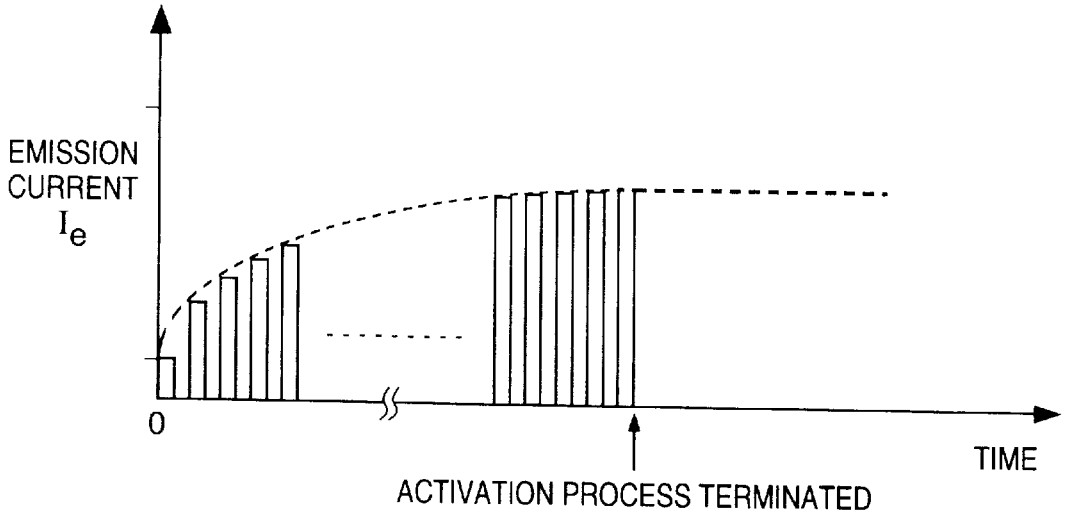
FIG. 16B is a graph showing a variance of emission current $I_e$.

Referring to FIG. 14D, reference numeral 1114 denotes an anode electrode connected to a DC high-voltage power supply 1115 and an ammeter 1116 to capture an emission current $I_e$ emitted from the surface-conduction electron-emitting device. (Note that when the substrate 1101 is incorporated into the display panel before the activation process, the phosphor surface of the display panel is used as the anode electrode 1114.) While applying a voltage from the activation power supply 1112, the ammeter 1116 measures the emission current $I_e$ to monitor the progress of the activation process so as to control the operation of the activation power supply 1112. FIG. 16B shows an example of the emission current $I_e$ measured by the ammeter 1116. As application of a pulse voltage from the activation power supply 1112 is started, the emission current $I_e$ increases with the elapse of time, gradually reaches saturation, and then barely increases. At the substantial saturation point of the emission current $I_e$, the voltage application by the activation power supply 1112 is stopped, and the activation process is then terminated.

Note that the above electrification conditions are preferable to manufacture the surface-conduction electron-emitting device of this embodiment. When the design of the surface-conduction electron-emitting device is changed, the conditions are preferably changed in accordance with the change in device design.

Figure 14E:
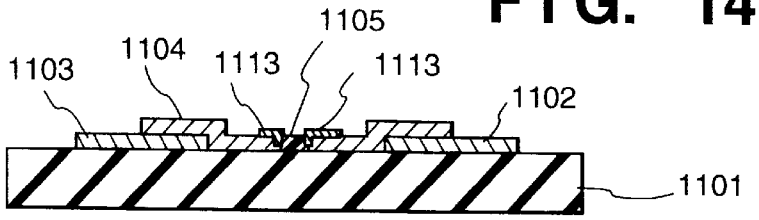

The plane type surface-conduction electron-emitting device shown in FIG. 14E is manufactured in the above manner.

<Step Type Surface-Conduction Electron-Emitting Device>

Another typical surface-conduction electron-emitting device having an electron-emitting portion or its peripheral portion formed of a fine particle film, i.e., a step type surface-conduction electron-emitting device, will be described below.

Figure 17:
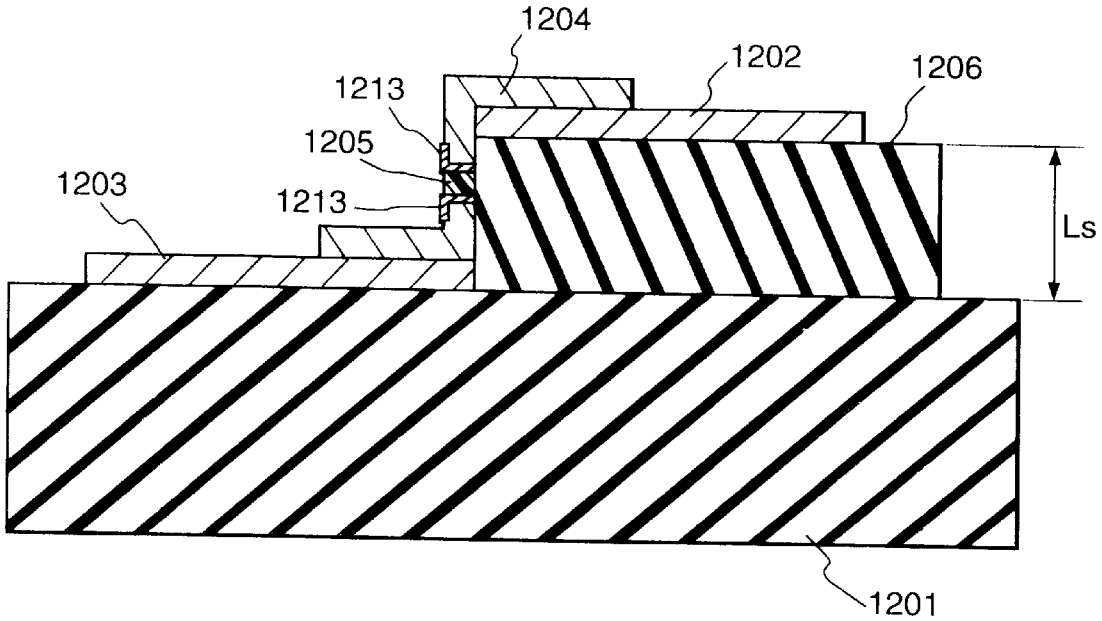
FIG. 17 is a sectional view of a step-type surface-conduction electron-emitting device utilized in the present embodiment.

FIG. 17 is a sectional view for explaining the basic arrangement of the step type surface-conduction electron-emitting device of this embodiment. Referring to FIG. 17, reference numeral 1201 denotes a substrate; 1202 and 1203, device electrodes; 1206, a step forming member; 1204, a conductive thin film using a fine particle film; 1205, an electron-emitting portion formed by an energization forming process; and 1213, a thin film formed by an activation process.

The step type device differs from the plane type surface-conduction electron-emitting device described above in that one device electrode (1202) is formed on the step forming member 1206, and the conductive thin film 1204 covers a side surface of the step forming member 1206. Therefore, the device electrode spacing L of the plane type surface-conduction electron-emitting device shown in FIGS. 13A and 13B corresponds to a step height Ls of the step forming member 1206 of the step type device. For the substrate 1201, the device electrodes 1202 and 1203, and the conductive thin film 1204 using a fine particle film, the same materials as enumerated in the description of the plane type surface-conduction electron-emitting device can be used. For the step forming member 1206, an electrically insulating material such as $SiO_2$ is used.

A method of manufacturing the step type surface-conduction electron-emitting device will be described below. FIGS. 19A to 19F are sectional views for explaining steps of manufacturing the step type surface-conduction electron-emitting device. The same reference numerals as in FIG. 17 are assigned to members in FIGS. 19A to 19F, and a detailed description thereof will be omitted.

Figure 19A:
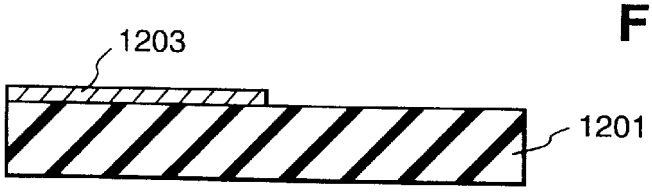

(1) As shown in FIG. 19A, the device electrode 1203 is formed on the substrate 1201.

Figure 19B:
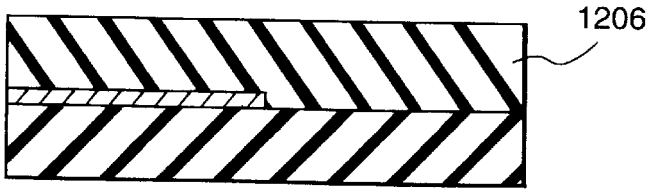
Figure 15C:
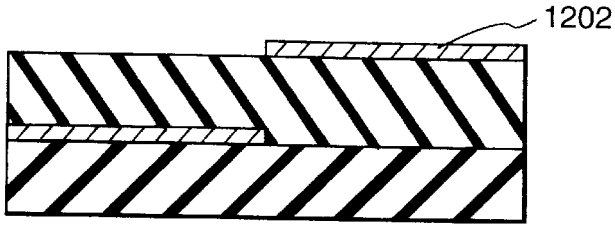

(2) As shown in FIG. 19B, the insulating layer for forming the step forming member is stacked on the resultant structure. For the insulating layer, e.g., an $SiO_2$ layer is formed by sputtering. However, another film-forming method such as vacuum deposition or printing may be used.

(3) As shown in FIG. 19C, the device electrode 1202 is formed on the insulating layer.

Figure 19D:
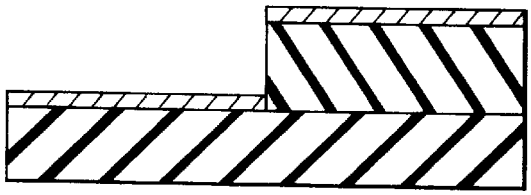

(4) As shown in FIG. 19D, a part of the insulating layer is removed by, e.g., etching to expose the device electrode 1203.

Figure 19E:
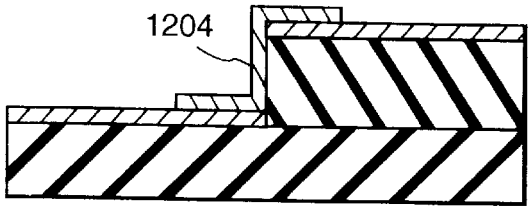

(5) As shown in FIG. 19E, the conductive thin film 1204 using a fine particle film is formed. To form the conductive thin film 1204, a film-forming method such as a coating method can be used, as in the plane type surface-conduction electron-emitting device.

(6) As in the plane type surface-conduction electron-emitting device, an energization forming process is performed to form an electron-emitting portion (the same energization forming process as that of the plane type surface-conduction electron-emitting device, which has been described with reference to FIG. 14C, is performed).

(7) As in the plane type surface-conduction electron-emitting device, an activation process is performed to deposit carbon or a carbon compound near the electron-emitting portion (the same activation process as that of the plane type surface-conduction electron-emitting device, which has been described with reference to FIG. 14D, is performed).

Figure 19F:
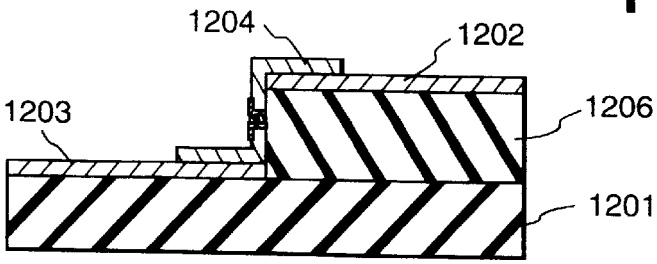

In the above-described manner, the step type surface-conduction electron-emitting device shown in FIG. 19F is manufactured.

<Characteristics of a Surface-Conduction Electron-Emitting Device Used in a Display Apparatus>

The device structure and method of manufacturing the plane type and step type surface-conduction electron emitting devices have been described above. The characteristics of these devices used in a display apparatus will now be described.

FIG. 18 illustrates a typical example of an (emission current $I_e$) vs. (applied device voltage $V_f$) characteristic and of a (device current $I_f$) vs. (applied device voltage $V_f$) characteristic of the devices used in a display apparatus. It should be noted that the emission current $I_e$ is so much smaller than the device current $I_f$ that it is difficult to use the same scale to illustrate it. Thus, the two curves in the graph are each illustrated using different scales.

The devices used in this display apparatus have the following three features in relation to the emission current $I_e$:

First, when a voltage greater than a certain voltage (referred to as a threshold voltage $V_{th}$) is applied to the device, the emission current $I_e$ increases rapidly. When the applied voltage is less than the threshold voltage $V_{th}$, on the other hand, almost no emission current $I_e$ is detected. In the case shown in FIG. 18, the threshold voltage $V_{th}$ is 8 V. In other words, the device is a non-linear device having the clearly defined threshold voltage $V_{th}$ with respect to the emission current $I_e$.

Second, since the emission current $I_e$ varies, depending upon the device current If, the magnitude of the emission current $I_e$ can be controlled by the device current If.

Third, since the response speed of the current $I_e$ emitted from the device is high in response to the voltage $V_f$ applied to the device, the amount of charge of the electron beam emitted from the device can be controlled by the length of time over which the voltage $V_f$ is applied.

By virtue of the foregoing characteristics, surface-conduction electron-emitting devices are ideal for use in a display apparatus. For example, in a display apparatus in which a number of the devices are provided to correspond to pixels of a displayed image, the display screen can be scanned sequentially to present a display if the first characteristic mentioned above is utilized. More specifically, a voltage greater than the threshold voltage $V_{th}$ is appropriately applied to drive devices in conformity with a desired light-emission luminance, and a voltage less than the threshold voltage $V_{th}$ is applied to devices that are in an unselected state. By sequentially switching over devices driven, the display screen can be scanned sequentially to present a display.

Further, by utilizing the second characteristic or third characteristic, the luminance of the light emission can be controlled. This makes it possible to present a grayscale display.

<Structure of Multi-Electron-Beam Source Having a Large Number of Devices Wired in Simple Matrix>

The structure of a multi-electron-beam source in which the above-described surface-conduction electron-emitting devices are arranged on a substrate and wired in a simple matrix will be described below.

Figure 20:
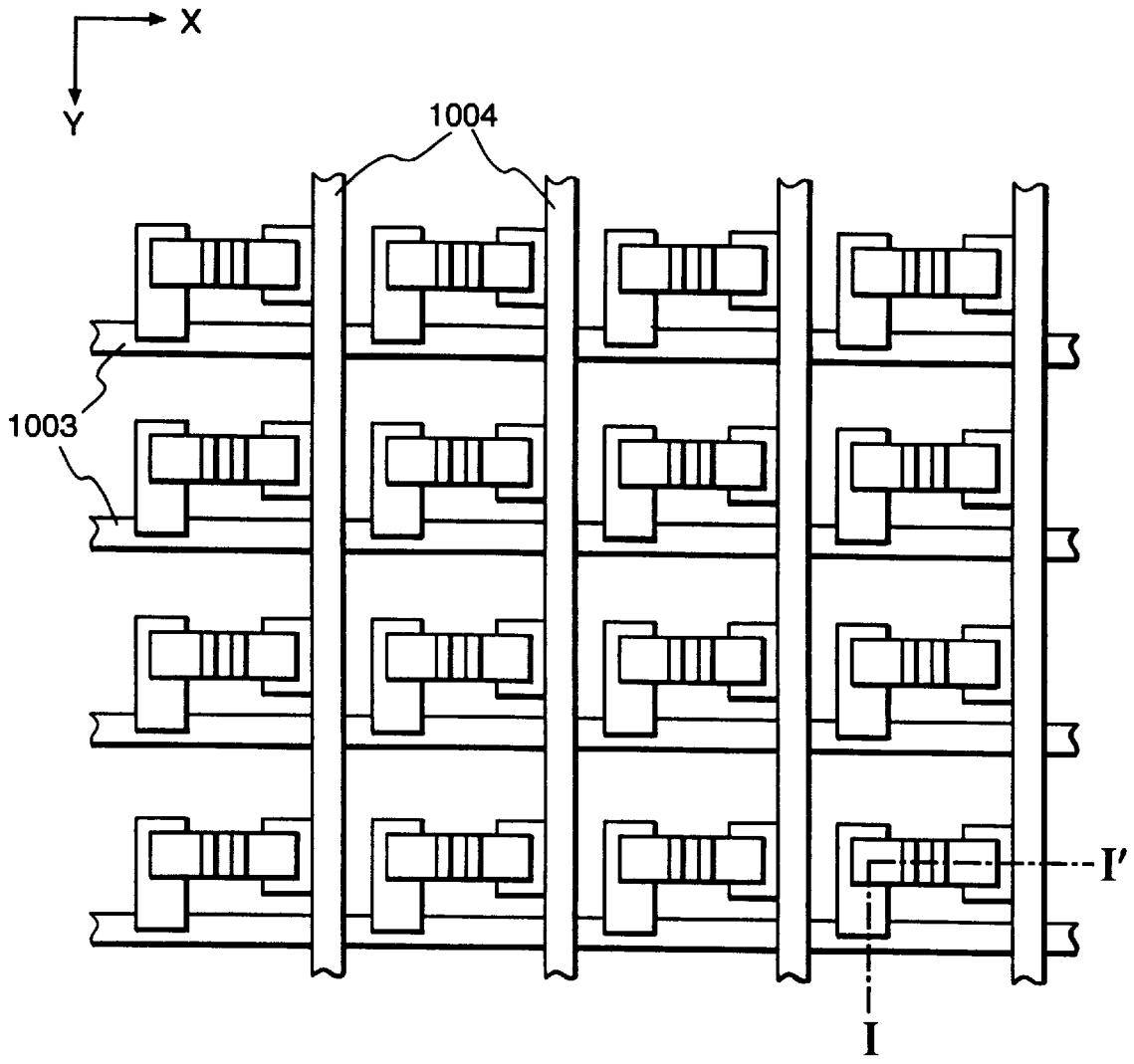
FIG. 20 is a plan view of a substrate of a multi-electron-beam source utilized in the present embodiment.

FIG. 20 is a plan view showing the multi-electron-beam source used in the display panel shown in FIG. 11. The surface-conduction electron-emitting devices each having the same structure as shown in FIGS. 13A and 13B are arranged on the substrate. These devices are wired in a simple matrix by the row wirings 1003 and the column wirings 1004. At intersections of the row wiring 1003 and the column wirings 1004, insulating layers (not shown) are formed between the electrodes such that electrical insulation is maintained.

Figure 21:
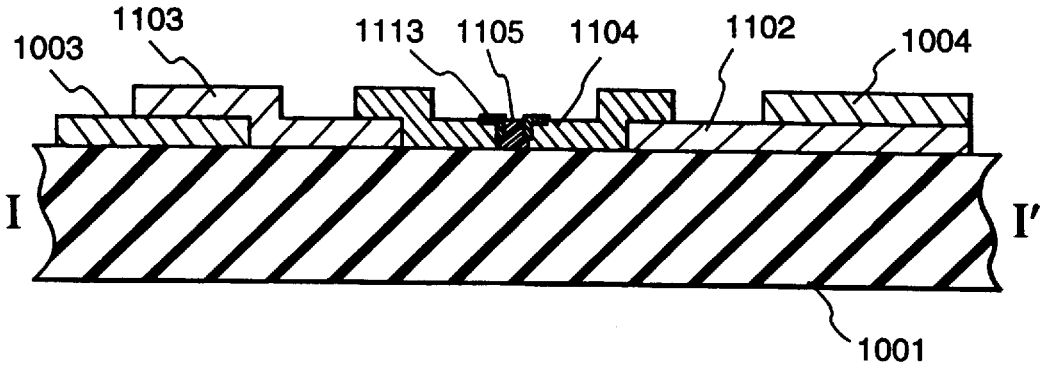
FIG. 21 is a partial cross sectional view of the substrate of the multi-electron-beam source utilized in the present embodiment.
Figure 22A:
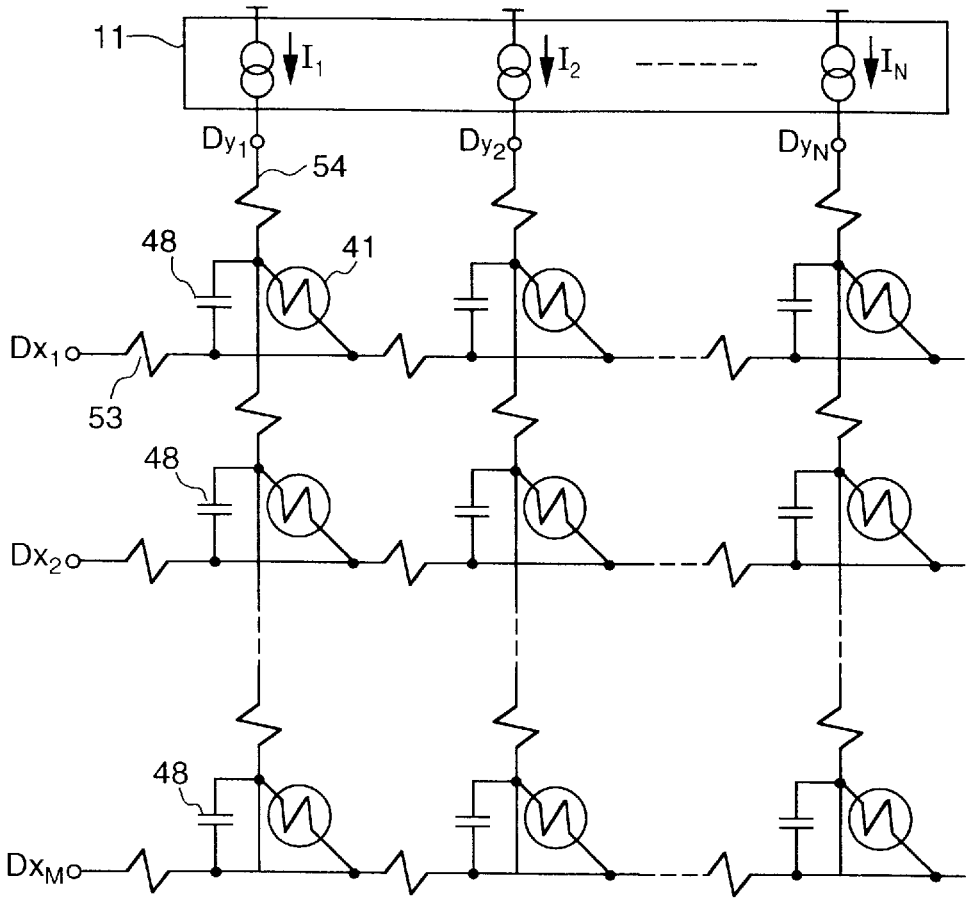
FIGS. 22A–22E are a diagram and graphs for explaining the conventional driving method and exemplifying problems thereof.
Figure 22B:
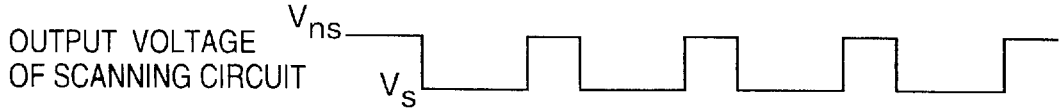
Figure 22C:
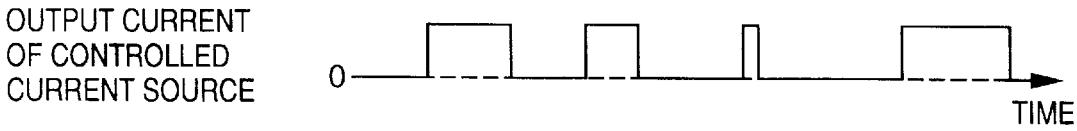
Figure 22D:
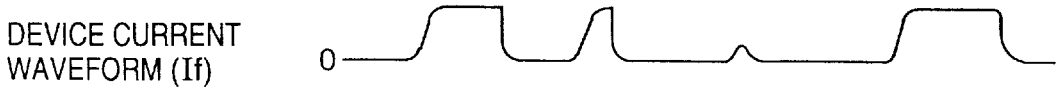
Figure 22E:
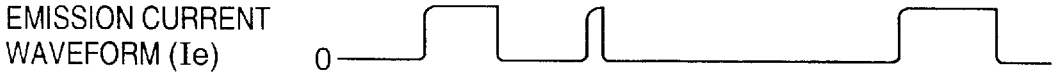
Figure 23:
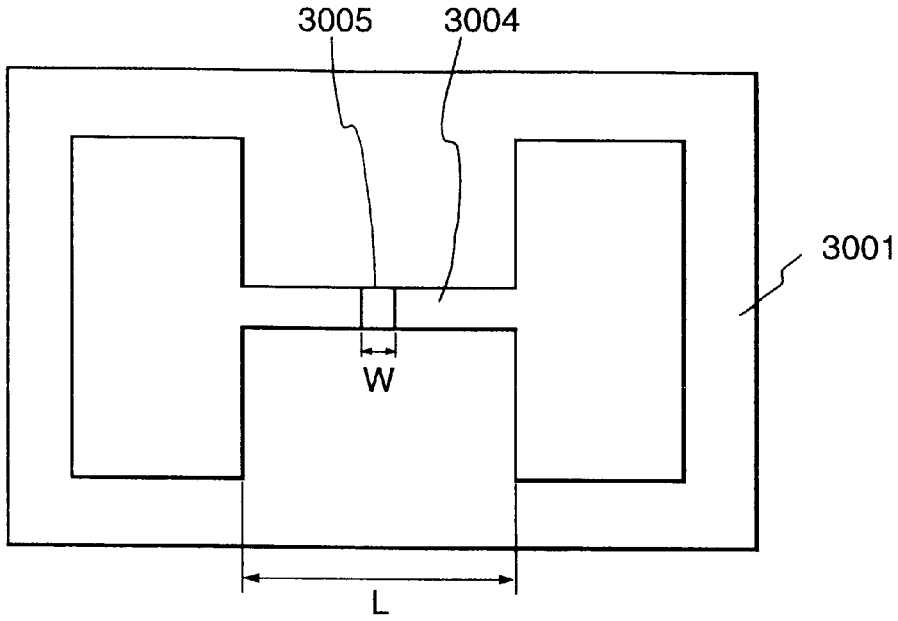
FIG. 23 shows a conventional surface-conduction electron-emitting device.
Figure 24:
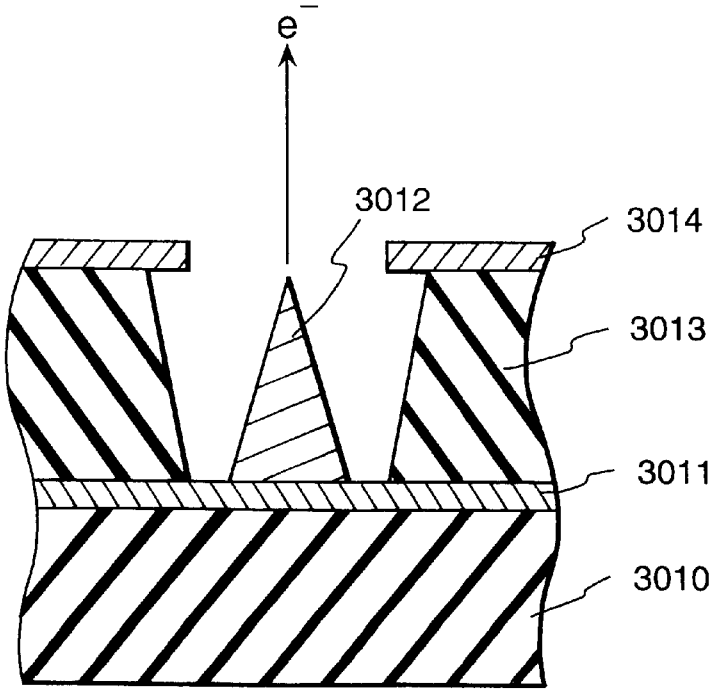
FIG. 24 shows a conventional FE-type device.
Figure 25:
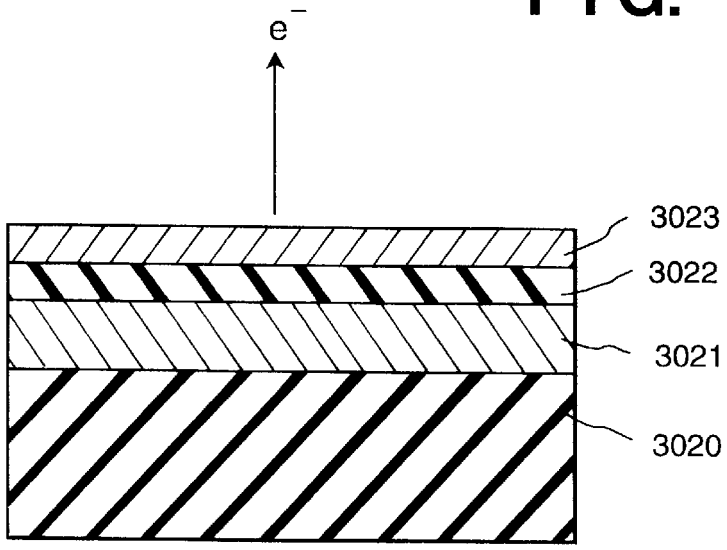
FIG. 25 shows a conventional MIM-type device.
Figure 26:
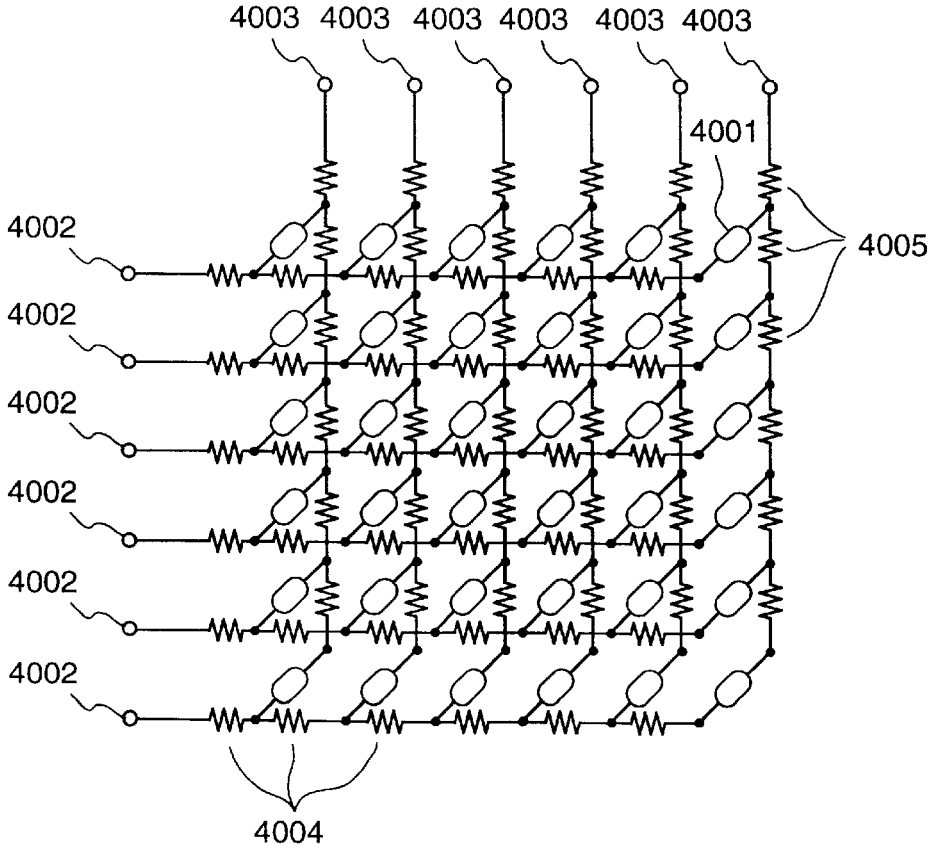
FIG. 26 is a view showing a method of wiring in a simple matrix.

FIG. 21 is a sectional view taken along a line I—I in FIG. 20.

The multi-electron-beam source having the above structure is manufactured in the following manner. The row wirings 1003, the column wiring 1004, the inter-electrode insulating layers (not shown), and the device electrodes and conductive thin films of the surface-conduction electron-emitting devices are formed on the substrate in advance. Thereafter, a power is supplied to the respective devices through the row wirings 1003 and the column wirings 1004 to perform the energization forming process and the activation process, thereby manufacturing the multi-electron-beam source.

The present invention is not limited to the above embodiments and various changes and modifications can be made within the spirit and scope of the present invention. Therefore, to apprise the public of the scope of the present invention, the following claims are made.

What is claimed is:

1. An electron-beam generating apparatus including (a) a multi-electron-beam source having a plurality of cold cathode devices wired with row wiring and column wiring and arranged in a matrix form, (b) scanning means connected to the row wiring, and (c) modulation means connected to the column wiring, said modulation means comprising:

a controlled current source for supplying a driving current pulse to the cold cathode devices; and a voltage source connected to the column wiring, wherein a charging voltage from said voltage source is applied to the column wiring in addition to the driving current pulse and in synchronization with a rise of the driving current pulse.

2. The electron-beam generating apparatus according to claim 1, wherein said charging-voltage applying means includes a rectifier.

3. The electron-beam generating apparatus according to claim 1, wherein said charging-voltage applying means includes a timer circuit and a connection switch.

4. The electron-beam generating apparatus according to claim 1, wherein voltage outputted by said voltage source is within a range of 0.5–0.9 times the maximum potential generated by said controlled current source.

5. The electron-beam generating apparatus according to claim 1, wherein said voltage source is a variable voltage source capable of adjusting an output voltage.

6. The electron-beam generating apparatus according to claim 1, wherein said controlled current source includes a constant current circuit and a current switch.

7. The electron-beam generating apparatus according to claim 1, wherein said controlled current source includes a V/I conversion circuit.

8. The electron-beam generating apparatus according to claim 1, wherein said charging-voltage applying means is a level shift circuit where a plurality of diodes or transistors are connected.

9. An image display apparatus comprising the electron-beam generating apparatus according to claim 1, and image forming members for forming an image when irradiated by an electron beam generated by said electron-beam generating apparatus.

10. An image display apparatus comprising the electron-beam generating apparatus according to claim 2, and image forming members for forming an image when irradiated by an electron beam generated by said electron-beam generating apparatus.

11. An image display apparatus comprising the electron-beam generating apparatus according to claim 3, and image forming members for forming an image when irradiated by an electron beam generated by said electron-beam generating apparatus.

12. An image display apparatus comprising the electron-beam generating apparatus according to claim 4, and image forming members for forming an image when irradiated by an electron beam generated by said electron-beam generating apparatus.

13. An image display apparatus comprising the electron-beam generating apparatus according to claim 5, and image forming members for forming an image when irradiated by an electron beam generated by said electron-beam generating apparatus.

14. An image display apparatus comprising the electron-beam generating apparatus according to claim 6, and image forming members for forming an image when irradiated by an electron beam generated by said electron-beam generating apparatus.

15. An image display apparatus comprising the electron-beam generating apparatus according to claim 7, and image forming members for forming an image when irradiated by an electron beam generated by said electron-beam generating apparatus.

16. An image display apparatus comprising the electron-beam generating apparatus according to claim 8, and image forming members for forming an image when irradiated by an electron beam generated by said electron-beam generating apparatus.

17. A method of driving an electron-beam generating apparatus including a multi-electron-beam source having a plurality of cold cathode devices wired with row wiring and column wiring and arranged in a matrix form, wherein a driving current pulse, modulated in accordance with modulation data inputted from an external unit, is supplied to said column wiring, and a charging voltage is applied to said column wiring in addition to the driving current pulse during a period from a rise of the driving current pulse until a point at which parasitic capacity of the multi-electron-beam source is charged to a predetermined level.

18. A method of driving an image display apparatus including a multi-electron-beam source having a plurality of cold cathode devices wired with row wiring and column wiring and arranged in a matrix form, wherein a driving current pulse, modulated in accordance with image data inputted from an external unit, is supplied to said column wiring, and a charging voltage is applied to said column wiring in addition to the driving current pulse during a period from a rise of the driving current pulse until a point at which parasitic capacity of the multi-electron-beam source is charged to a predetermined level.

19. An electron-beam generating apparatus comprising:

an electron-beam source having a plurality of electron-emitting devices wired with row wiring and column wiring and arranged in a matrix form;

a controlled current source which is electrically connected to the column wiring and supplies a driving current pulse for driving the electron-emitting devices; and a voltage source connected to the column wiring, wherein a charging voltage from said voltage source is applied to the column wiring in addition to the driving current pulse and in synchronization with a rise of the driving current pulse, whereby practical response speed of the electron-emitting devices is increased.

20. An electron-beam generating apparatus comprising:

an electron-beam source having a plurality of electron-emitting devices wired with row wiring and column wiring and arranged in a matrix form;

a scanning circuit connected to the row wiring;

a controlled current source which is electrically connected to the column wiring and supplies a driving current pulse for driving the electron-emitting devices; and a voltage source connected to the column wiring, wherein an output voltage from said voltage source is applied to the column wiring in addition to the driving current pulse and in synchronization with a rise of the driving current pulse, whereby the speed of a rise of current flowing through the electron-emitting devices connected to said column wiring is increased.

21. The electron-beam generating apparatus according to claim 1, wherein said modulation means further comprises charging-voltage applying means for electrically connecting the voltage source and the column wiring.

* * * * *

UNITED STATES PATENT AND TRADEMARK OFFICE

CERTIFICATE OF CORRECTION

PATENT NO. : 6,195,076 B1
DATED : February 27, 2001
INVENTOR(S) : Takamasa Sakuragi et al.

Figure 5F:
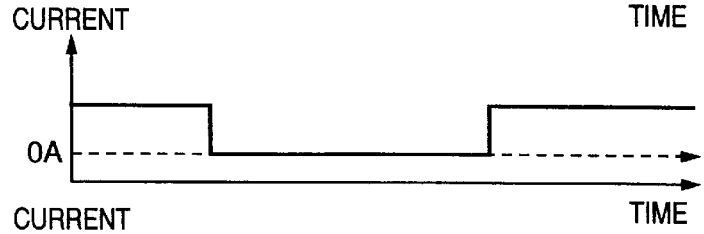
Figure 5G:
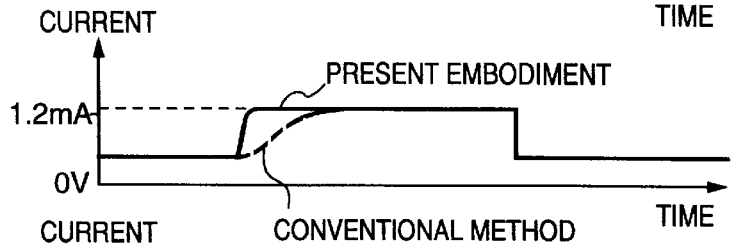
Figure 5H:
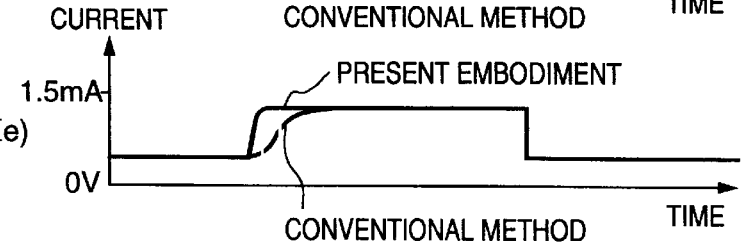

It is certified that error appears in the above-identified patent and that said Letters Patent is hereby corrected as shown below:

Drawings,
Sheet 5 of 23, FIG. 5F, "CURENT" should read -- CURRENT --; and
Sheet 5 of 23, FIG. 5G, "CURENT" should read -- CURRENT --.

Column 2,
Line 11, "Electronics" should read -- Electronics and --; and
Line 12, "Spindt" should read -- Spindt, --; and
"Thin" should read -- Thin-Film --.

Column 11,
Line 63, "1.5 mA." should read -- 1.2 mA. --; and
Line 67, "1.5 mA" should read -- 1.2 mA --.

Column 17,
Line 49, "are" should read -- and --.

Column 20,
Line 18, "$1x10^6\Omega$Å" should read -- $1x10^6\Omega$ --.

Column 23,
Line 33, line "I-I" should read -- line I-I' --.

Signed and Sealed this

Twenty-sixth Day of February, 2002

*Attest:*

*Attesting Officer*

JAMES E. ROGAN
*Director of the United States Patent and Trademark Office*